US009318229B2

(12) United States Patent
Kurochi et al.

(10) Patent No.: US 9,318,229 B2
(45) Date of Patent: Apr. 19, 2016

(54) COLLIMATOR PLATE, COLLIMATOR MODULE, RADIATION DETECTING DEVICE, RADIOGRAPHY APPARATUS AND ASSEMBLING METHOD OF COLLIMATOR MODULE

(75) Inventors: Haruo Kurochi, Tokyo (JP); Katsumasa Nose, Tokyo (JP); Richard P. VanDeWeghe, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 775 days.

(21) Appl. No.: 13/482,556

(22) Filed: May 29, 2012

(65) Prior Publication Data

US 2013/0322603 A1 Dec. 5, 2013
US 2014/0362978 A9 Dec. 11, 2014

(51) Int. Cl.
*G21K 1/02* (2006.01)

(52) U.S. Cl.
CPC ..... *G21K 1/025* (2013.01)

(58) Field of Classification Search
CPC ..... G21K 1/025; G21K 1/02; A61B 6/06; A61B 6/4291
See application file for complete search history.

(56) References Cited

U.S. PATENT DOCUMENTS

| | | | | |
|---|---|---|---|---|
| 5,099,134 | A * | 3/1992 | Hase et al. | 378/149 |
| 7,612,343 | B2 | 11/2009 | Vickers | |
| 7,844,032 | B2 | 11/2010 | Vermilyea et al. | |
| 7,916,839 | B2 | 3/2011 | Halazonetis et al. | |
| 8,126,119 | B2 | 2/2012 | Kurochi | |
| 8,139,717 | B2 | 3/2012 | Harding et al. | |
| 2005/0135562 | A1 * | 6/2005 | Freund et al. | 378/147 |
| 2009/0225955 | A1 | 9/2009 | Igarashi et al. | |
| 2011/0096895 | A1 | 4/2011 | Kurochi | |

FOREIGN PATENT DOCUMENTS

JP 2010127630 6/2010

* cited by examiner

*Primary Examiner* — Glen Kao

(57) ABSTRACT

A method is provided for assembling a collimator module including a plurality of first collimator plates arrayed in a first direction, each first collimator plate having a plurality of slots formed on a plate surface, and a plurality of second collimator plates arrayed in a second direction orthogonal to the first direction, wherein each second collimator plate penetrates respective slots along the first direction so as to form a lattice-shape. The method includes positioning the plurality of first collimator plates by moving a first collimator plate in one direction along the second direction, so that a side wall of a first cutout formed on an edge of a radiation incident side or a radiation output side of the first collimator plate contacts a member extending in the first direction.

14 Claims, 21 Drawing Sheets

COLLIMATOR PLATE, COLLIMATOR MODULE, RADIATION DETECTING DEVICE, RADIOGRAPHY APPARATUS AND ASSEMBLING METHOD OF COLLIMATOR MODULE

BACKGROUND OF THE INVENTION

The present invention relates to an alignment technique for assembling collimator modules.

In the radiography apparatus, as represented by an X-ray CT apparatus or a general imaging apparatus, a collimator unit placed on the detecting surface side of a radiation detector is highly important for preventing degradation of images due to scattered radiation.

Conventionally, a collimator unit has a plurality of collimator plates arrayed in one direction. In recent years, because of rising demand of increasing the number of row-detectors, miniaturization and image quality enhancement in the radiation detecting device, a collimator unit having a plurality of collimator plates assembled in lattice-shape for preventing two-dimensionally the scattered radiation entering the detection surface, is proposed. For example, FIGS. 1-7 of JP Unexamined Patent Application No. 2010-127630 disclose such a lattice-shaped collimator unit.

Also, another type of the lattice-shaped collimator unit can be considered as below. For example, a lattice-shaped collimator unit includes a plurality of collimator modules. Each of the plurality of collimator modules includes a plurality of first collimator plates arrayed in a first direction, and a plurality of second collimator plates arrayed in a second direction orthogonal to the first direction. Each of the plurality of first collimator plates has multiple slots (long and thin holes) on the plate surface, and each of the plurality of second collimator plates is inserted into the slots.

When assembling the above type of collimator unit, in order to insert the second collimator plate smoothly into the slot and place it without bending it, the plurality of first collimator plates is required to be positioned precisely in the second direction.

Actually, however, a collimator module or a collimator unit has an enormous number of collimator plates, for example, ranging from several dozens to several hundreds. That makes it difficult to place all collimator plates at correct positions in a precise manner and at low cost.

For example, assuming that a collimator unit of the above type is manufactured, the plurality of first collimator plates is supported by two end-blocks having respective grooves for positioning each edge of the first collimator plate in the second direction.

In this case, a bottom surface of the groove of the end-block is processed as a reference surface, and the position of the first collimator plate may be aligned by contacting the edge portion of the first collimator to the reference surface. However, even under the present technology, it is difficult to process each groove with required high precision, which worsens yields and increases manufacturing cost.

Under such circumstances, low-cost and high precision collimator modules are demanded.

BRIEF DESCRIPTION OF THE INVENTION

In a first aspect, a method for assembling a collimator module is provided, the collimator module including a plurality of first collimator plates arrayed in a first direction, having a plurality of slots formed on each its plate surface, and a plurality of second collimator plates arrayed in a second direction orthogonal to the first direction, each second collimator plate penetrates the respective slots in the first direction so as to form a lattice-shape. The method includes a first step of positioning the plurality of first collimator plates by moving the first collimator plate in one direction of the second direction, so that a side wall of a first cutout formed on an edge of a radiation incident side or a radiation output side of the first collimator plate is contacted to a member extending to the first direction.

In a second aspect, the method for assembling the collimator module according to the first aspect is provided, wherein in the first step, the first collimator plate is moved by hooking a springy member on the first cutout and pulling the first collimator plate with a tension.

In a third aspect, the method for assembling the collimator module according to the first aspect is provided, wherein in the first step, the first collimator plate is moved by hooking a springy member on a second cutout which is different from the first cutout and is formed on the edge of the first collimator plate, and pulling the first collimator plate with a tension.

In a fourth aspect, the method for assembling the collimator module according to the third aspect is provided, wherein the first cutout is formed on one end side of the second direction of the edge, and the second cutout is formed on the other end side of the second direction of the edge.

In a fifth aspect, the method for assembling the collimator module according to any one of the second to forth aspects is provided, wherein after the first step, the method includes a second step of inserting the plurality of second collimator plates into the respective slots, and a third step of sandwiching each second collimator plate between the side walls of each slot by hooking the springy member on the first cutouts of part of the plurality of first collimator plates and moving the part of the plurality of first collimator plates in a direction opposite to the one direction.

In a sixth aspect, the method for assembling the collimator module according to any one of the second to forth aspects is provided, wherein after the first step, the method includes a second step of inserting the plurality of collimator plates into the respective slots, and a third step of sandwiching each second collimator plate between the side walls of each slot by hooking the springy member on a third cutout which is different from the first cutout and formed on one end side of the second direction of the edge of part of the plurality of first collimator plates and moving the part of the plurality of first collimator plates in a direction opposite to the one direction.

In a seventh aspect, the method for assembling the collimator module according to the fifth or sixth aspect is provided, wherein the part of the plurality of first collimator plates are odd or even numbered collimator plates of the plurality of first collimator plates.

In an eighth aspect, the method for assembling the collimator module according to any one of the first to seventh aspects is provided, wherein before the first step, the method includes placing a first block and a second block with a space in the second direction, wherein the first and second block have the respective grooves for placing the edges of the plurality of first collimator plates in the second direction, and inserting the plurality of first collimator plates into the respective grooves.

In a ninth aspect, the method for assembling the collimator module according to the eighth aspect is provided, further including a fourth step of bonding the plurality of first collimator plates, the plurality of second collimator plates, the first block and the second block.

In a tenth aspect, the method for assembling the collimator module according to any one of the first to ninth aspects is provided, wherein the collimator module is used for a radiation tomographic imaging apparatus.

In an eleventh aspect, the method for assembling the collimator module according to any one of the first to ninth aspects is provided, wherein the collimator module is used for a radiation projection imaging apparatus.

In a twelfth aspect, a first collimator plate having a plurality of slots on its plate surface for inserting a second collimator plate is provided, the first collimator plate including a cutout formed on an edge of a radiation incident side or a radiation output side of the first collimator plate, having side walls used as a reference surface for positioning the first collimator plate in the direction of the edge.

In a thirteenth aspect, a collimator module including a first collimator plate is provided, the first collimator plate having a plurality of slots on its plate surface for inserting a second collimator plate, and a cutout formed on an edge of a radiation incident side or a radiation output side of the first collimator plate, the cutout having side walls used as a reference surface for positioning the first collimator plate in the direction of the edge.

In a fourteenth aspect, a radiation detecting device including a collimator module including a first collimator plate is provided, the first collimator plate having a plurality of slots on its plate surface for inserting a second collimator plate, and a cutout formed on an edge of a radiation incident side or a radiation output side of the first collimator plate, the cutout having side walls used as a reference surface for positioning the first collimator plate in the direction of the edge.

In a fifteenth aspect, a radiography apparatus including a radiation detecting device including a collimator module comprising a first collimator plate is provided, the first collimator plate having a plurality of slots on its plate surface for inserting a second collimator plate, and a cutout formed on an edge of a radiation incident side or a radiation output side of the first collimator plate, the cutout having side walls used as a reference surface for positioning the first collimator plate in the direction of the edge.

In a sixteenth aspect, the radiography apparatus according to the fifteenth aspect is provided, wherein the radiography apparatus is used for tomographic imaging.

In a seventeenth aspect, the radiography apparatus according to the fifteenth aspect is provided, wherein the radiography apparatus is used for projection imaging.

According to the embodiments described herein, a collimator plate suitable for its position alignment is provided, by forming at least one cutout on its edge and processing with high precision at least one side wall of the cutout as a reference surface for positioning. Thus, the precise position alignment of the collimator plate can be accomplished at relatively low cost.

DETAILED DESCRIPTION OF THE INVENTION

Hereinafter, exemplary embodiments will be described. The invention is not limited to the embodiments specifically described herein.

Figure 1:
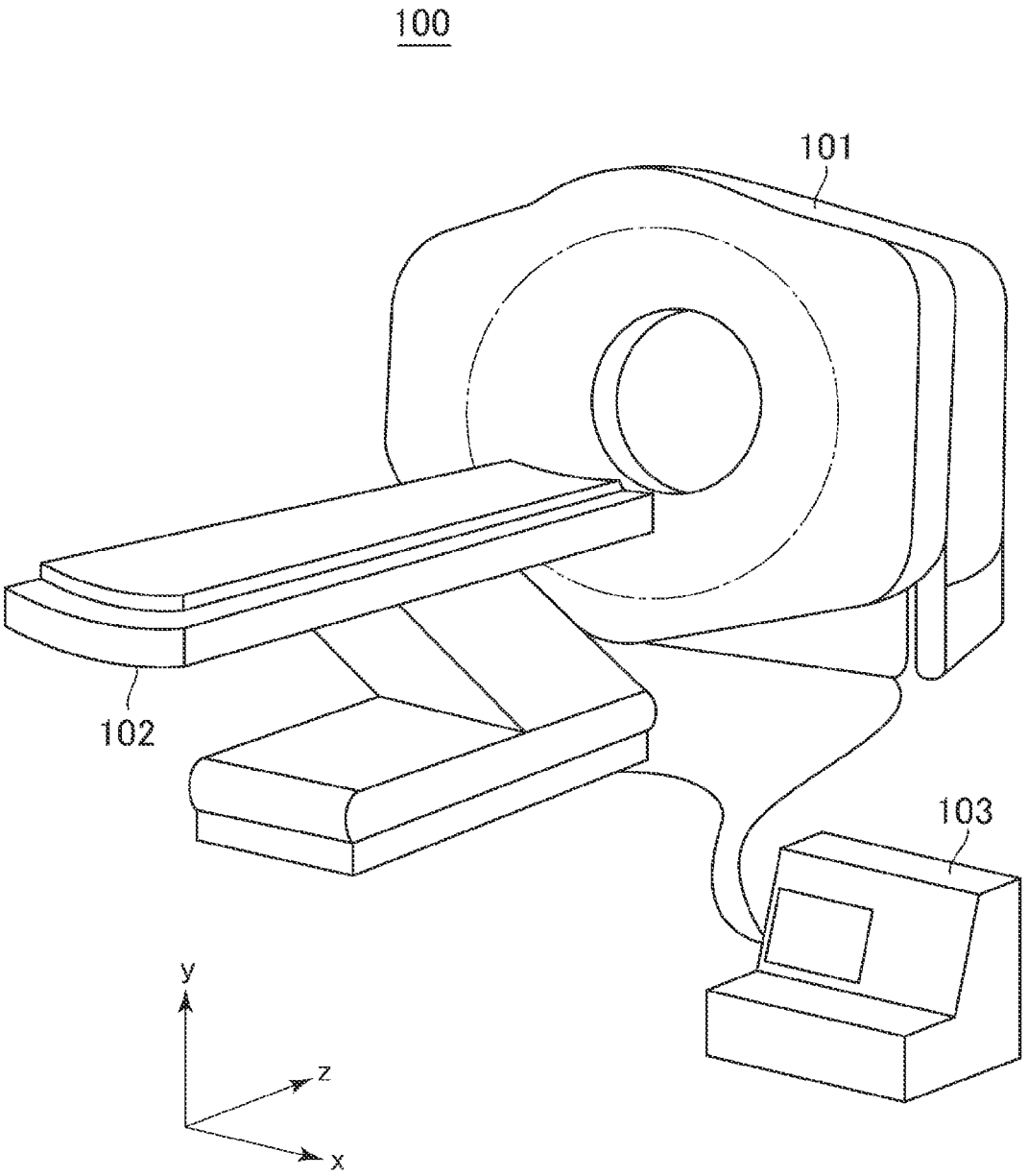
FIG. 1 is a perspective view of an exemplary X-ray CT apparatus.

FIG. 1 is a perspective view of an exemplary X-ray CT apparatus 100. As shown in FIG. 1, the X-ray CT apparatus includes a scanning gantry 101 for scanning a subject and acquiring a projection data, and a cradle 102 on which the subject is placed and going in to and out of a bore 104 of the scanning gantry 101, which is a scanning area. The X-ray CT apparatus further comprises an operating console 103 for operating the X-ray CT apparatus 100 and reconstructing images based on the acquired projection data.

The cradle 102 contains a motor therein for elevating and horizontally moving the cradle 102. The subject is placed onto the cradle 102 and the cradle 102 goes in to and out of the bore 104 of the scanning gantry 101.

The operating console 103 has an input device receiving inputs from an operator, and a monitor for displaying images. Also, the operating console 103 has a central processing device for controlling each device to acquire the projection data of the subject or processing three-dimensional image reconstruction, a data acquisition buffer for acquiring obtained data by the scanning gantry 101, and a memory device for memorizing programs, data, and the like. These devices composing the operating console 103 are not shown in FIG. 1.

The scanning gantry 101 has an X-ray tube and an X-ray detection device for scanning the subject.

Figure 2:
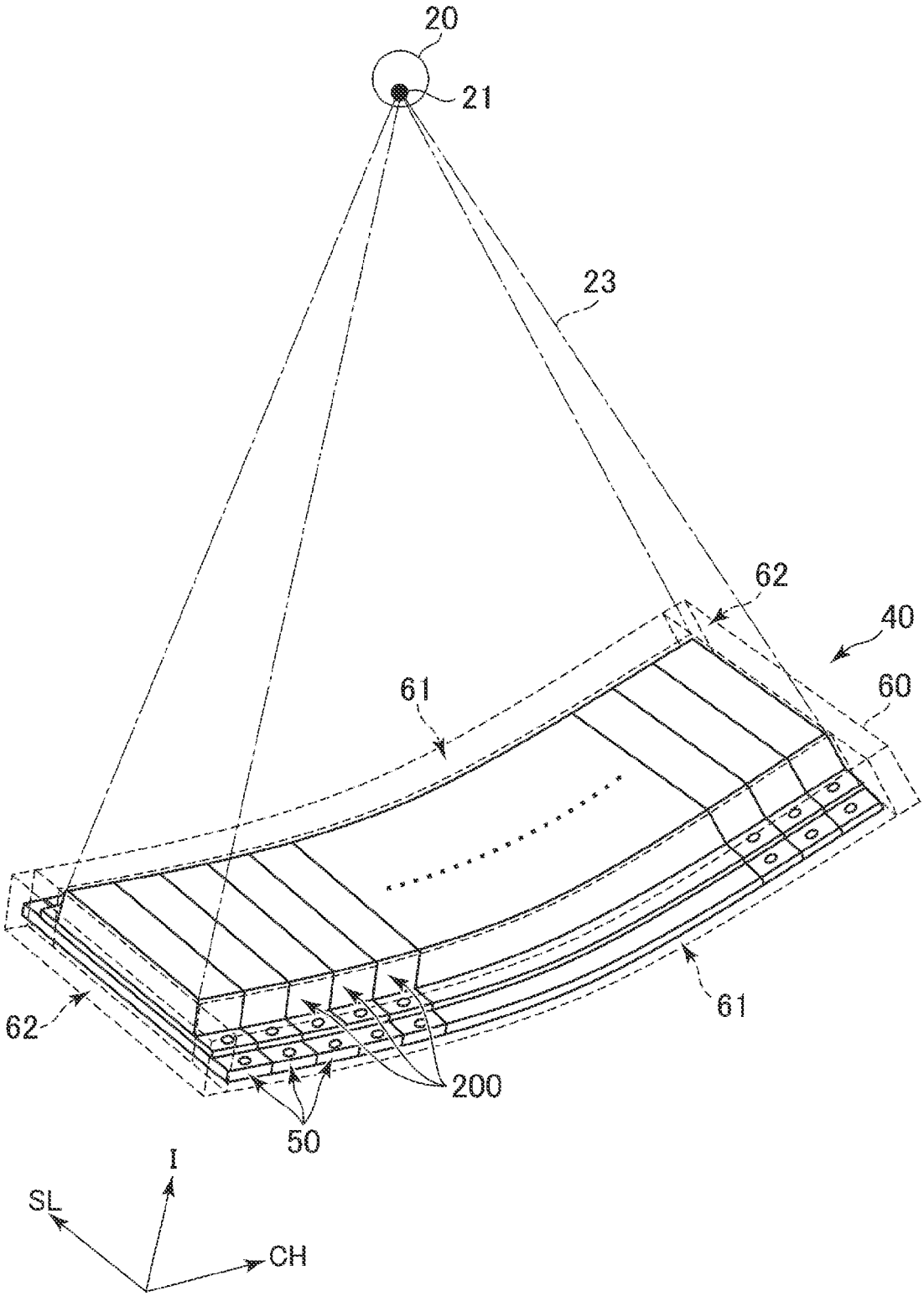
FIG. 2 is a perspective view for explaining the X-ray tube and X-ray detection device.

FIG. 2 is a perspective view for explaining the X-ray tube and X-ray detection device. Here, as shown in FIG. 2, a rotational axis direction of the scanning gantry 101 (a horizontal moving direction of the cradle 102 or a body axis direction of the subject) is referred as a slice direction (SL direction). A fan angle direction of an X-ray beam 23 is referred as a channel direction (CH direction). Also, the direction perpendicular to the channel direction and slice direction, and directed toward the rotation center, or the scanning center of the scanning gantry 101, is referred as the iso-center direction (I direction). In the channel direction (CH direction), slice direction (SL direction) and iso-center direction (I direction), the direction toward the arrow in FIG. 2 is (+) direction and the opposite direction is the (−) direction.

The X-ray detection device 40 has a plurality of X-ray detection modules 50 for detecting the X-ray, a plurality of two-dimension collimator modules 200 for collimating X-ray beams 23 from an X-ray focal point 21 of an X-ray tube 20, and a base 60 for fixing the plurality of X-ray detection modules 50 and the plurality of two-dimension collimator modules 200 in reference positions.

The plurality of two-dimension collimator modules 200 is arrayed in the CH direction and forms a two-dimension collimator device. The plurality of X-ray detection modules 50 corresponding to the plurality of two-dimension collimator modules 200 is arrayed in the CH direction. One X-ray detection module 50 corresponds to one collimator module 200. The X-ray detection module 50 is placed on the X-ray output side of the two-dimension collimator module 200. The X-ray detection module 50 detects the X-rays passed through the subject which is put on the cradle 102 and transferred into the bore.

The X-ray detection module 50 has a scintillator block, which is not shown in FIG. 2, that emits visible light by receiving X-rays, and a photodiode chip, which is not shown in FIG. 2, having a photodiode for photoelectric conversion arrayed two-dimensionally in the CH direction and SL direction. The X-ray detection module 50 further has a semiconductor chip, which is not shown in FIG. 2, having functions to accumulate outputs from the photodiode chip on the substrate and to switch outputs for changing a slicing thickness.

The base 60 is a rectangular frame-shaped having a pair of circular-arc base members 61 and a pair of linear base members 62 connecting the distal ends of each base member 61. Also, positioning pins or positioning holes for positioning the plurality of two-dimension collimator modules 200 are provided on the base side of the base member 61.

Regarding the base 60, a length in the SL direction is in a range of 350 mm to 400 mm for example, a thickness is in a range of 35 mm to 40 mm for example and length of an inner space between the base member 61 and 62 is in a range of 300 mm to 350 mm. Also, a width of each two-dimension collimator module 200 in the CH-direction is 50 mm for example. Hereinafter, the two-dimension collimator module 200 will be described.

A material of the base 60 can be, for example, an aluminum alloy or a carbon fiber reinforced plastic (CFRP). CFRP is a composite material of a carbon fiber and a thermoset resin. Because the aluminum alloy or CFRP is light in weight and strong and also has a characteristic of high rigidity, the base 60 can be rotated at high speed in the scanning gantry 101 of the X-ray CT apparatus 100 without generating unnecessary centrifugal forces. Additionally, the base 60 and two-dimension collimator modules 200 fixed thereon hardly strains or bends.

Although the two-dimension collimator modules 200 drawn in FIG. 2 are simplified, actually several dozens of two-dimension collimator modules 200 may be fixed on one base 60.

Hereinafter, a configuration of the two-dimension collimator module will be described further in detail.

Figure 3:
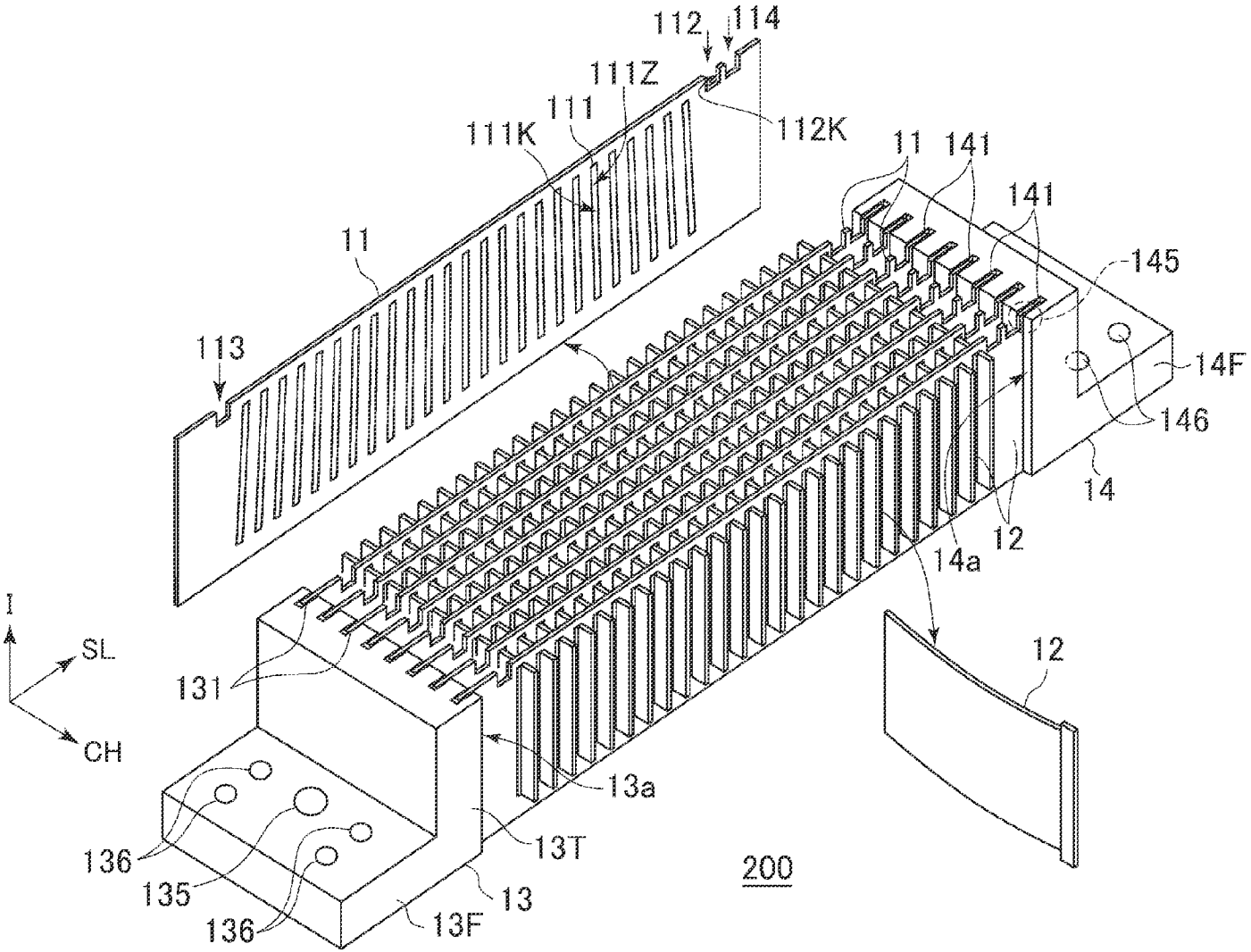
FIG. 3 is a perspective view of the two-dimension collimator module.
Figure 4A:
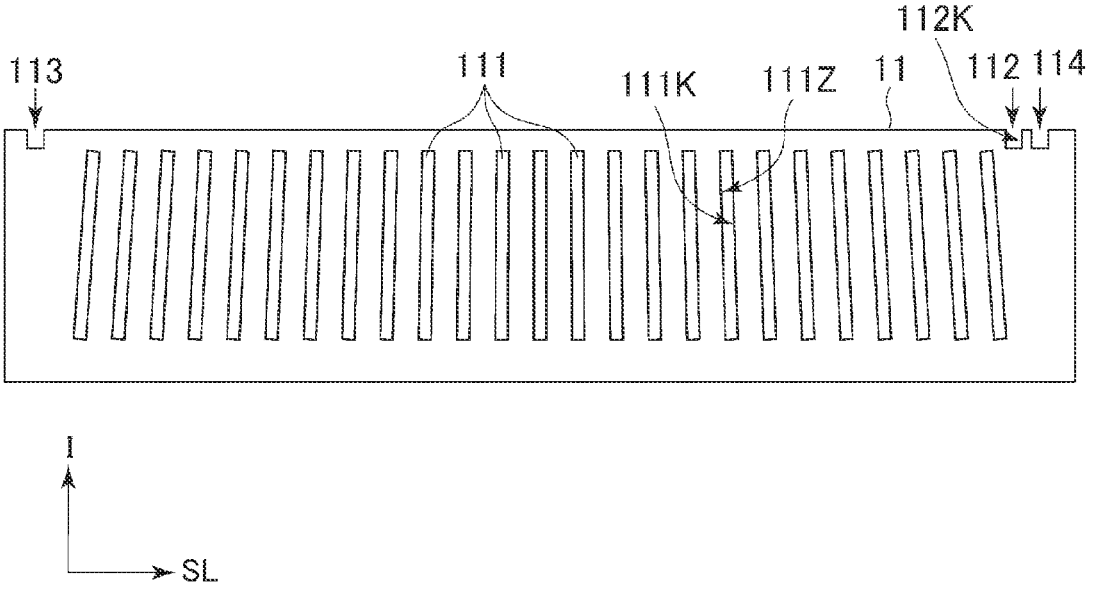
FIGS. 4A and 4B are views of a first collimator plate and a second collimator plate, respectively, which configures the two-dimension collimator module.
Figure 4B:
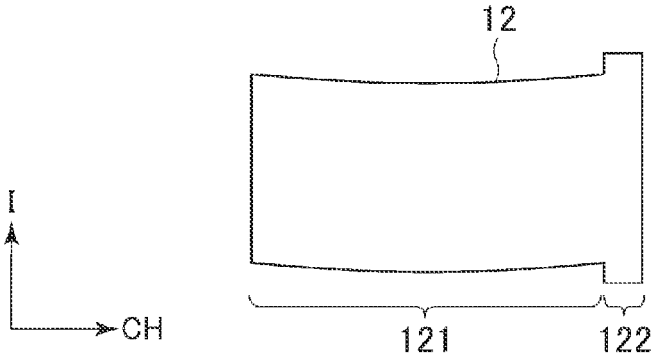

FIG. 3 is a perspective view of the two-dimension collimator module in this embodiment. FIGS. 4A and 4B are drawings of a first collimator plate and a second collimator plate, respectively, which configures the two-dimension collimator module.

As shown in FIG. 3, the two-dimension collimator module 200 has a plurality of first collimator plates 11, a plurality of second collimator plates 12, a top-end block 13 and a bottom-end block 14. For the purpose of explaining the configuration easily, fewer first collimator plates 11 and second collimator plates 12 are drawn in FIG. u3, however, a number of the first collimators plates 11 is ideally between 32 to 64 plates, and a number of the second collimator plates 12 is ideally between 129 to 257 plates.

A plurality of first collimator plates 11 is placed so that its plate surfaces are almost parallel to each other and there is an interval in the CH-direction between the first collimator plates.

The top-end block 13 and the bottom-end block 14 are placed so that the plurality of first collimator plates 11 is supported by the two end-blocks in the SL-direction.

The plurality of second collimator plates 12 is assembled approximately orthogonally to the plurality of first collimator plates 11. Namely, the plurality of first collimator plates 11 and the plurality of second collimator plates 12 are assembled, which forms a lattice-shaped two-dimension collimator portion.

A positioning of the top-end block 13, the bottom-end block 14, the plurality of first collimator plates 11 and the plurality of second collimator plates 12 is done by a predetermined method. And these blocks and plates are bonded to each other using adhesive and the like.

A configuration of components of the two-dimension collimator module will be described further in detail.

As shown in FIG. 4A the first collimator plate 11 has a rectangular-shape or mildly-curved fan-shape. The first collimator plate 11 is made of a heavy-metal having a high X-ray absorption rate, such as molybdenum, tungsten or lead. When the two-dimension collimator modules 200 are mounted onto the base 60, a plate surface of the first collimator plate 11 is parallel to radiating direction of the X-ray beam 23 from the X-ray focal point 21, and the longitudinal direction thereof corresponds to the SL direction or a cone angle direction of the X-ray beam 23. Here, a thickness of the first collimator plate 11 is approximately 0.2 mm.

A plurality of slots 111, which are long and thin holes for inserting the second collimator plate 12, are formed on the plate surface of the first collimator plate 11. The plurality of slots 111 is formed so that when the two-dimension collimator module 200 is mounted onto the base 60, each of the plurality of slots 111 is parallel to the radiating direction of the X-ray beam 23 from the X-ray focal point 21.

Incidentally, when considering of inserting the second collimator plate 12 into the slot 111 smoothly, in the exemplary embodiment, a width of the slot 111 in the SL-direction is much wider than a plate thickness of the second collimator plate 12. Whereas if the width of the slot 111 is too wide, the rigidity of the first collimator plate 11 becomes low, which causes strain or bend while assembling or scanning. If these are taken into consideration, the thickness of the second collimator plate 12 may be between 0.06 mm to 0.22 mm, the width of the slot 111 in the SL direction may be between 0.1 mm to 0.28 mm, and the width of the slot 111 is wider than thickness of the second collimator plate 12.

Also, if the slot 111 is processed by wire electric discharge, a diameter of the wire can be selected from 0.1 mm, 0.2 mm or 0.3 mm; however, considering a balance between the costs and processing precision, in some embodiments, a 0.2 mm diameter wire is utilized. In the exemplary embodiment, the width of the slot 111 in the SL direction is between 0.2 mm to 0.28 mm.

Here, the width of the slot 111 in the SL-direction is approximately 0.24 mm and the length of the slot 111 is approximately 15.4 mm.

As shown in FIG. 4A, a first cutout 112, a second cutout 113 and a third cutout 114 are formed on an edge of the X-ray incident side of the first collimator plate 11. These cutouts are used during an assembly of the two-dimension collimator module. In this embodiment, these cutouts all have nearly rectangular shapes and have a size between 2 to 5 mm. The cutouts can be processed and formed simultaneously with manufacturing of the first collimator plates 11 by a wire electric discharge processing method or the like.

The wire electric discharge processing is a particularly effective method of forming cutouts on the edge of the plate-shaped material, and the method allows a high precision, low cost processing relatively easily.

The first cutout 112 is formed at a position closer to the end of the first collimator plate 11 in the +SL-direction. The first cutout 112 is used as a reference for positioning the first collimator plate 11 in the SL-direction. A side wall 112K of the first cutout 112 on the +SL side is processed with a very high precision, and used as a reference surface having a precise positional relationship with the plurality of slots 111 formed on the plate surface.

The second cutout 113 is formed at a position closer to the end of the first collimator plate 11 in the −SL-direction. The second cutout 113 is used for moving or sliding the first collimator 11 to the −SL-direction. For example, one end of a springy member, such as a tip of a plate spring bent in arch shape can be hooked on the second cutout 113, and tension is applied in the −SL-direction.

The third cutout 114 is formed at a position next to the first cutout 112 in the +SL-direction. The third cutout 114 is used for moving or sliding the first collimator 11 to the +SL-direction. For example, one end of a springy member, such as a tip of a plate spring bent in arch shape can be hooked on the third cutout 114, and tension is applied in the +SL-direction.

A method for assembling the two-dimension collimator module using cutouts will be described further in detail afterward.

As shown in FIG. 4B a second collimator plate 12 has a fan-shaped main portion 121 and a rectangular-shaped end portion 122. Similar to the first collimator plate 11, the second collimator plate 12 is made of a heavy-metal having a high X-ray absorption rate. When the second collimator module 200 is mounted onto the base 60, the plate surface of the second collimator plate 12 becomes parallel to the radiating direction of the X-ray beam 23 from the X-ray focal point 21, and a curved long-edge direction that forms the fan-shaped main portion 121 matches to the CH-direction.

As shown in FIG. 3, the second collimator plate 12 is inserted into the slot 111 so as to penetrate through each row of slots 111 of the plurality of first collimator plates 11 aligned in the CH-direction. The rectangular-shaped end portion of the second collimator plates 12 is wider than the length of the slot 111 in the I-direction. Thus the end portion works as a stopper when inserted to the slot 111. Also, when a plurality of two-dimension collimator modules 200 is mounted onto the base 60, tips of the main portion of the second collimator plates 12 of one two-dimension collimator module 200, and tips of the rectangular portion of the second collimator plates 12 of next one two-dimension collimator module 200, meet each other in the SL-direction, and form a part of the lattice-shaped two-dimension collimator.

Incidentally, regarding the second collimator plate 12, a position gap may occur due to heat deformation. Whenever the gap occurs, the shielding condition of the X-ray changes, which causes crosstalk between detected cells and alters the detection property of the X-ray detection device 20. This can be effectively prevented by thinning a plate thickness of the second collimator plate 12. Whereas if the plate thickness is too thin, rigidity of the second collimator plate 12 becomes low, which causes a bend of the second collimator plate 12 during assembling or scanning Considering such conditions, plate thickness of the second collimator plate 12 is may be between 0.06 mm to 0.14 mm, and is more preferable to fall between 0.08 mm to 0.12 mm in one embodiment. In the exemplary embodiment, the plate thickness of the second collimator plate 12 is approximately 0.1 mm. Also, the width of the second collimator plate 12 in the I-direction is approximately 15 mm in the exemplary embodiment.

The top-end block 13 and the bottom-end block 14 are made of lightweight metals such as aluminum or plastic.

As shown in FIG. 3, the top-end block 13 has a post 13T extending in the I-direction and orthogonal to the CH-direction and SL-direction, and a flange 13F protruding to the −SL-direction and these are formed as one unit. Therefore, the top-end block 13 has opposite "L" shape when viewed from the +CH direction toward the −CH-direction.

Similarly, the bottom-end block 14 has a post 14T extending to the I-direction and a flange 14F protruding to the +SL direction and these are formed as one unit. Therefore, the bottom-end block 14 has "L" shape when viewed from the +CH direction toward the −CH direction.

Also, as shown in FIG. 3, a positioning hole is formed at the center of the flange 13F, and a positioning pin 135 is inserted into this positioning hole and fixed. Similarly, a positioning hole is formed at the center of the flange 14F, and a positioning pin 145 is inserted into this positioning hole and fixed. When these positioning pins 135, 145 are respectively fixed to predetermined positions, the two-dimension collimator module 200 will be positioned to the reference position on the base 60.

Surrounding the positioning pin 135 (145), four positioning holes 136 (146) are formed. These four positioning holes 136 (146) are formed so that the X-ray detection module 50 shown in FIG. 2 can be accurately mounted.

As shown in FIG. 3, the surface 13*a* of the top-end block 13 and the surface 14*a* of the bottom-end block 14 are facing each other, and a plurality of grooves for inserting the first collimator plates 11 is formed on each surface 13*a* and 14*a*. The plurality of grooves is formed so that when the two-dimension collimator module 200 is mounted onto the base 60, the grooves are positioned along the radiating direction of the X-ray beam 23 radiated from the X-ray focal point 21.

A plurality of first grooves 131 having nearly constant depth in the SL-direction is formed on the surface 13*a* of the top-end block 13. Similarly, a plurality of second grooves 141 having nearly constant depth in the SL-direction is formed on the surface 14*a* of the bottom-end block 14. Here in both the first groove 131 and second groove 141, the depth in the SL-direction is approximately 1 mm and the width in the CH-direction is approximately 0.24 mm.

The side wall 111K of the slot 111 in the +SL direction is a reference surface, and is formed so as to have an accurate positional relationship with the side wall 112K of the first cutout 112 of the first collimator plate 11.

Both end walls of the first collimator plate 11 in the SL direction does not contact any of the bottom surfaces of the first and second grooves 131, 141. Thus, there is some space between the ends and the bottom surfaces.

Figure 17:
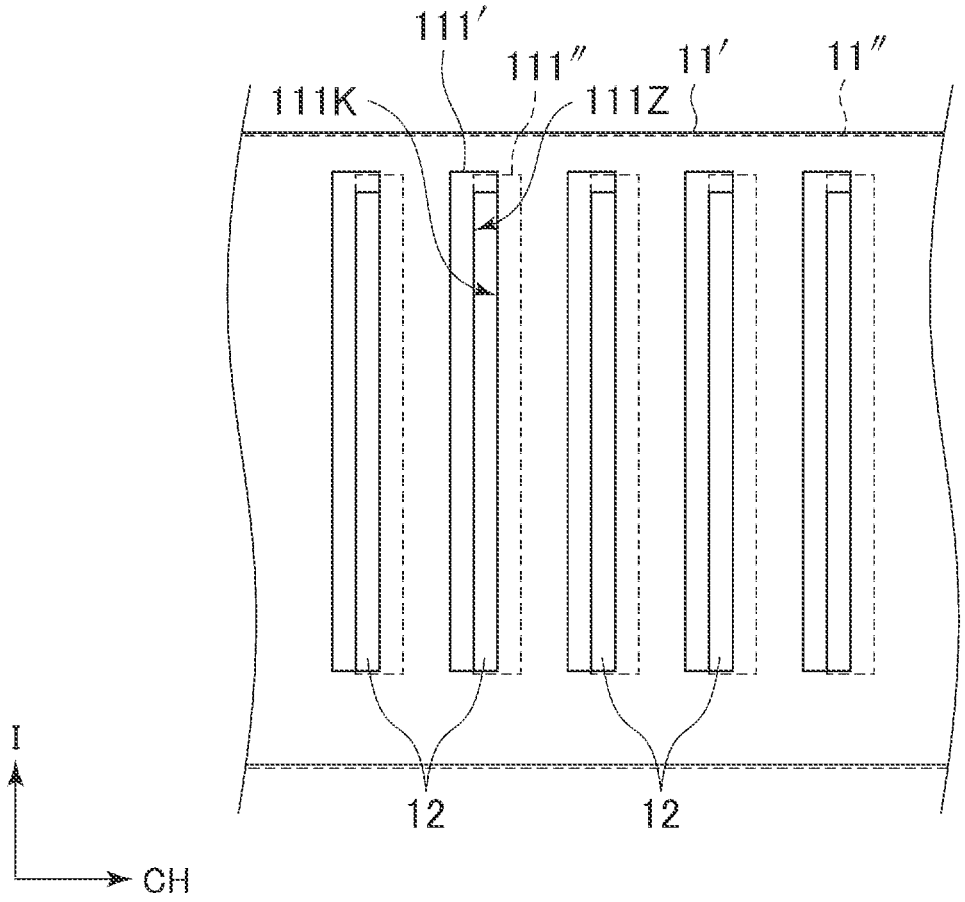
FIG. 17 is a drawing showing a positional relationship between the slots and the second collimator plate, when the plurality of first collimator plates is moved toward the bottom-end block.

Among both side walls of the slots 111' of the odd-numbered first collimator plates 11' in the SL-direction, the plate surface of the second collimator plate 12 in the +SL-direction contacts only the side wall 111K in the +SL-direction (see FIG. 17).

Among both side walls of the slots 111" of the even-numbered first collimator plates 11" in the SL-direction, the plate surface of the second collimator plate 12 in the −SL-direction contacts only the side wall 111Z in the −SL-direction (see FIG. 17).

Thus, each second collimator plate 12 is sandwiched in between the side walls 111K of the slots 111' in the +SL direction of the odd-numbered first collimator plates 11' and the side walls 111Z of the slots 111" in the −SL direction of the even-numbered first collimator plates 11".

The plurality of first collimator plates 11, the plurality of second collimator plates 12, the top-end block 13 and the bottom-end block 14 are bonded together using adhesive.

Hereinafter, a method for assembling the two-dimension collimator module in this embodiment is described.

Figure 5:
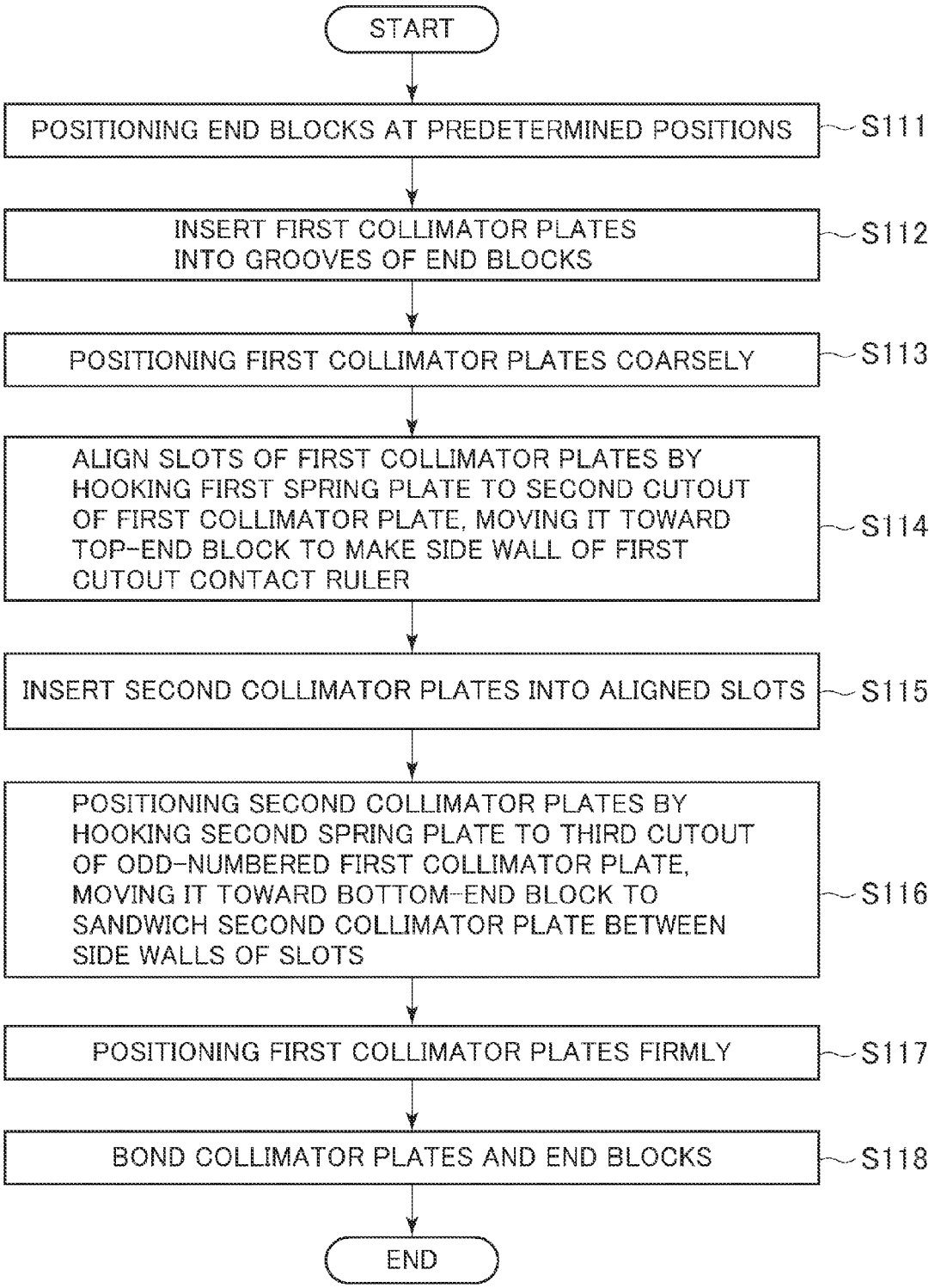
FIG. 5 is a flow-chart showing a method for assembling the two-dimension collimator module.

FIG. 5 is a flow-chart showing the method for assembling the two-dimension collimator module in this embodiment.

Figure 6:
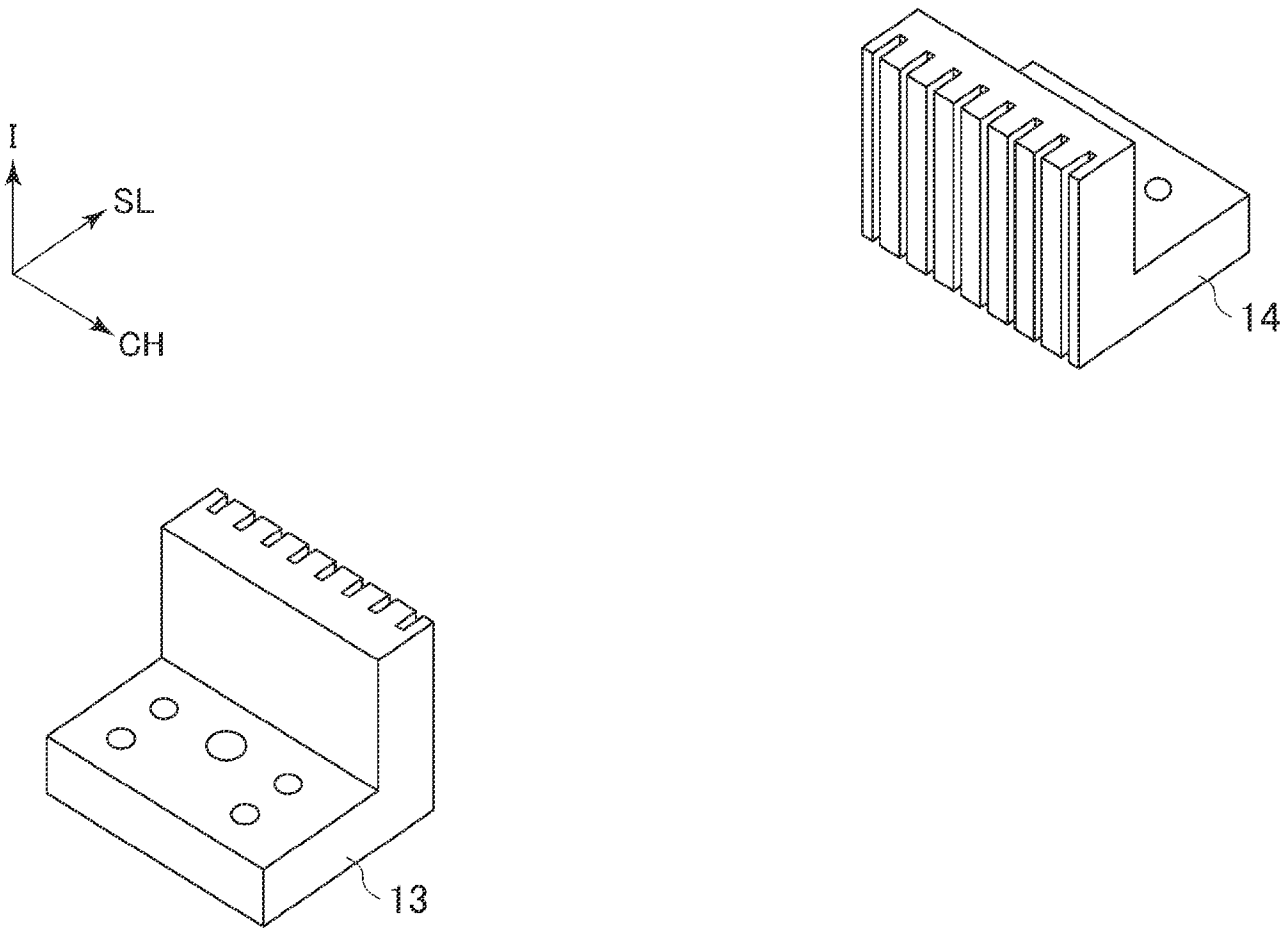
FIG. 6 is a drawing explaining a step for positioning a top-end block and a bottom-end block.

In step S111, as shown in FIG. 6, each of the top-end block 13 and the bottom-end block 14 is positioned at a predetermined position using a jig.

Figure 7:
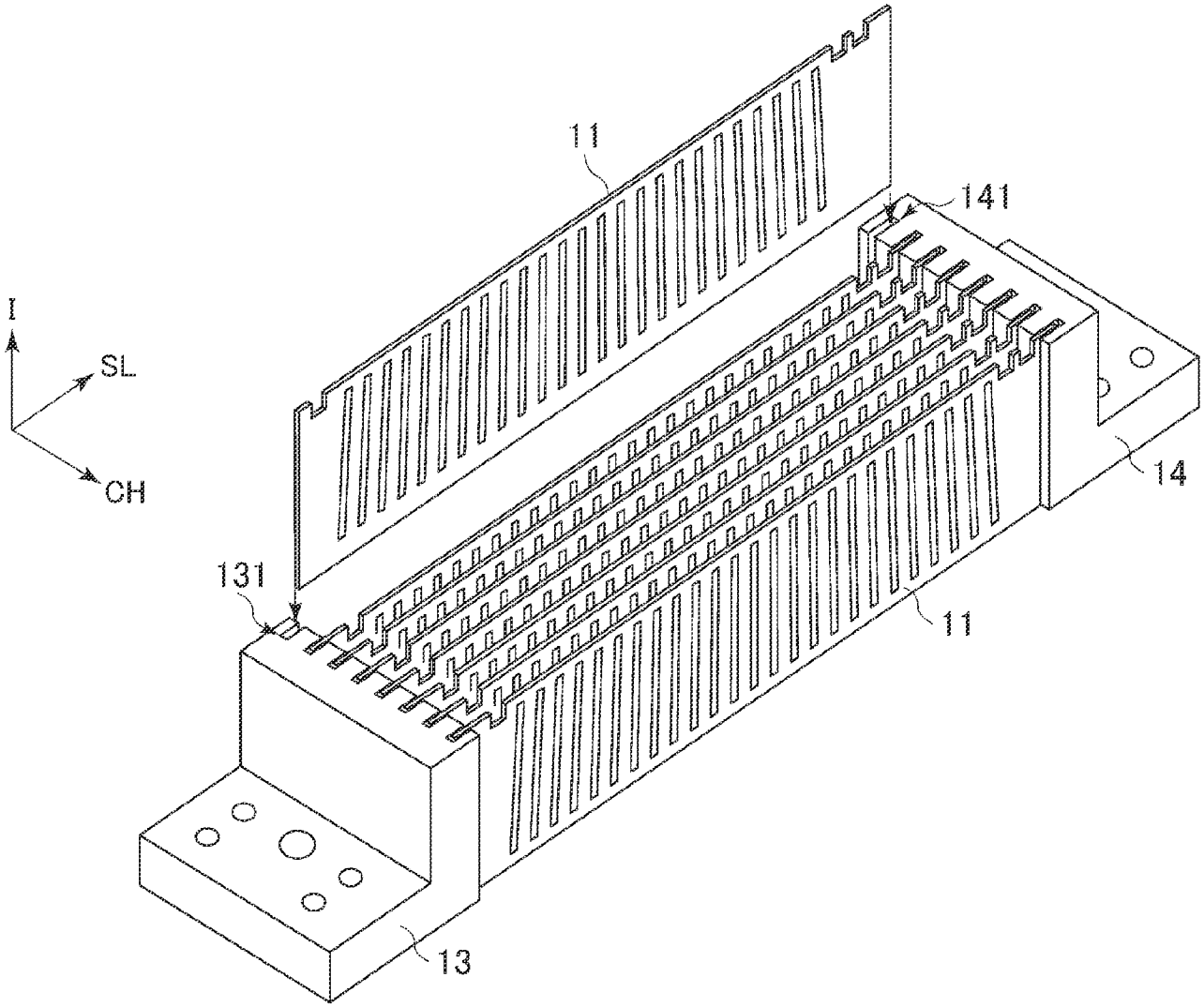
FIG. 7 is a drawing explaining a step for inserting a plurality of first collimator plates into the grooves formed on the top-end block and the bottom-end block.

In step S112, as shown in FIG. 7, a plurality of first collimator plates 11 is inserted into the respective grooves of the top-end block 13 and bottom-end block 14.

Figure 12:
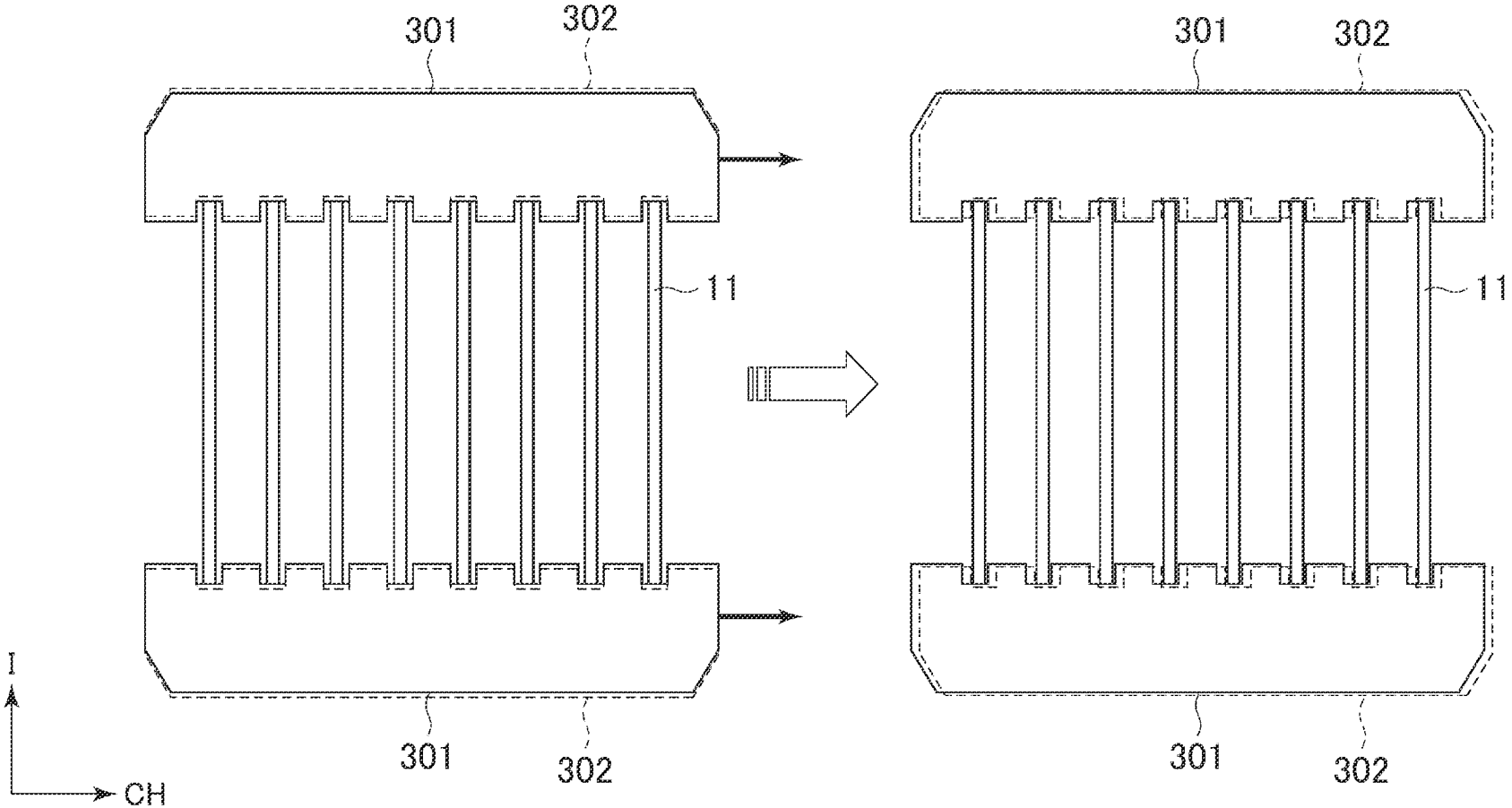
FIG. 12 is a drawing explaining a step for positioning a first collimator plate.

In step S113, the plurality of first collimators 11 are coarsely positioned using a jig. For example, as shown in FIG. 12, each top and bottom edge of the first collimator plate 11 is gently nipped in the CH-direction by using aligning members 301, 302 with comb-shaped cutouts. At this point, the first collimator plates 11 can be moved in the SL-direction.

Figure 8:
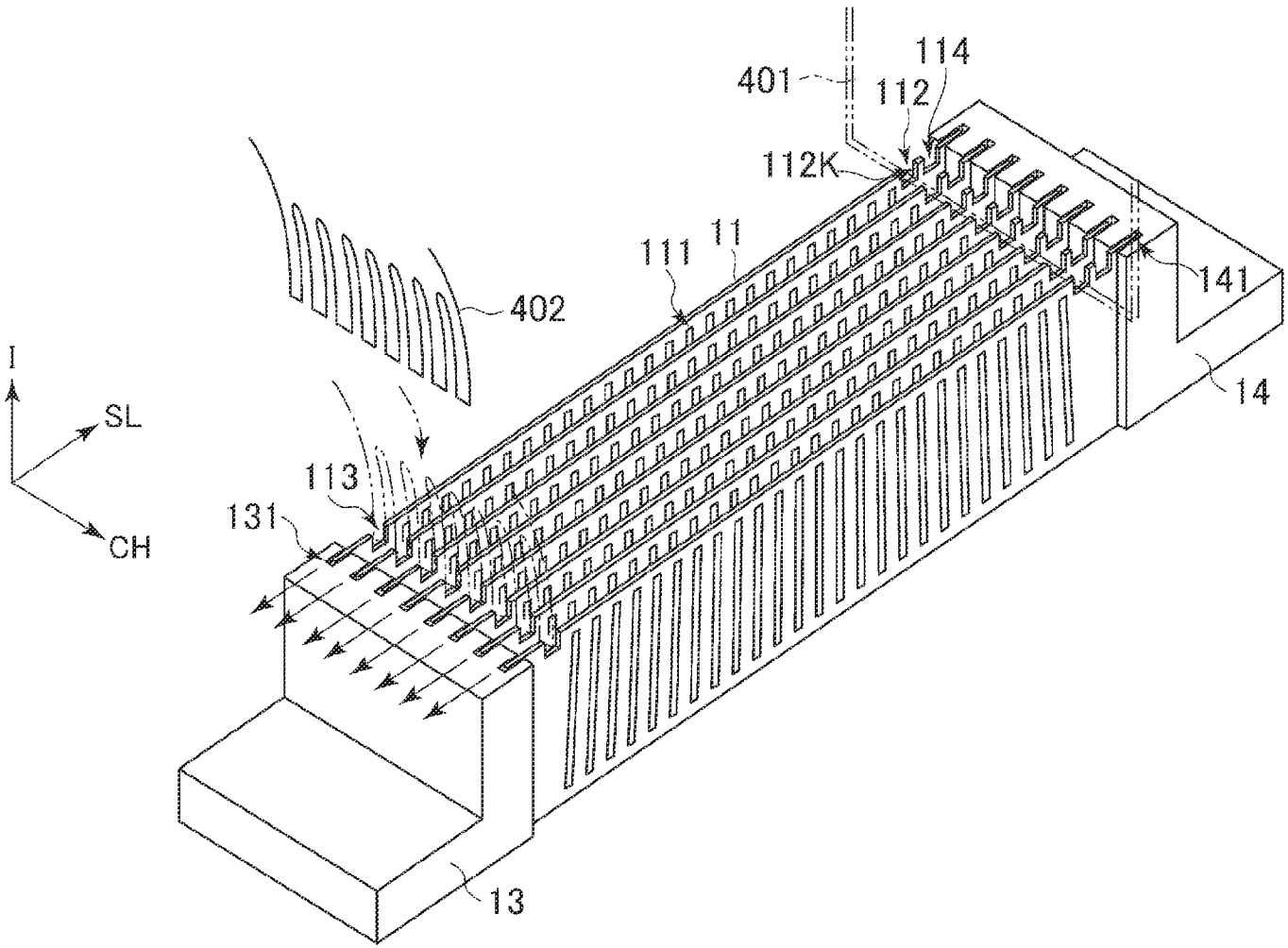
FIG. 8 is a drawing explaining a step for moving the plurality of first collimator plates toward the top-end block and aligning the slots.
Figure 13:
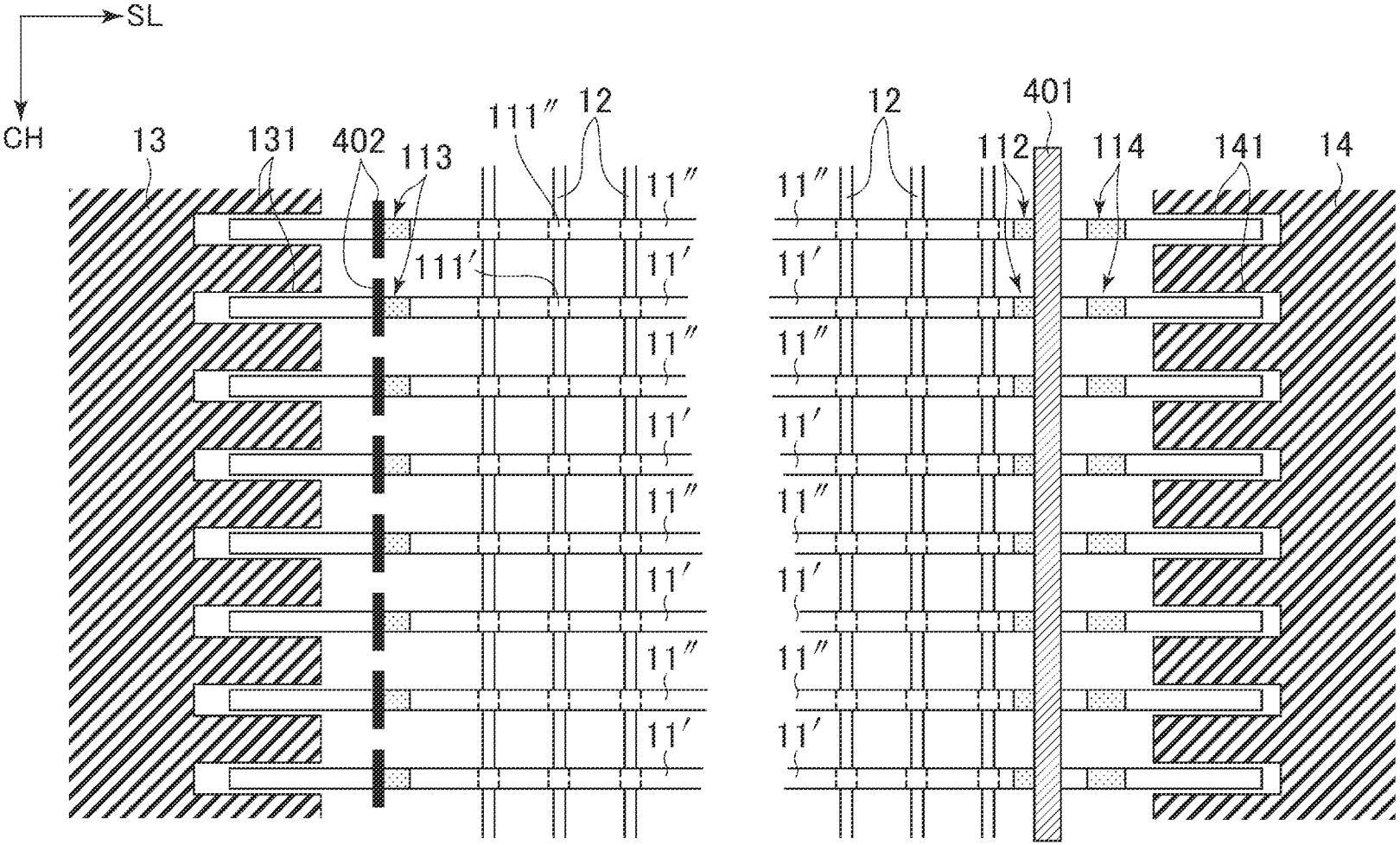
FIG. 13 is an enlarged view around the grooves, wherein the plurality of first collimator plates is moved toward the top-end block.
Figure 15:
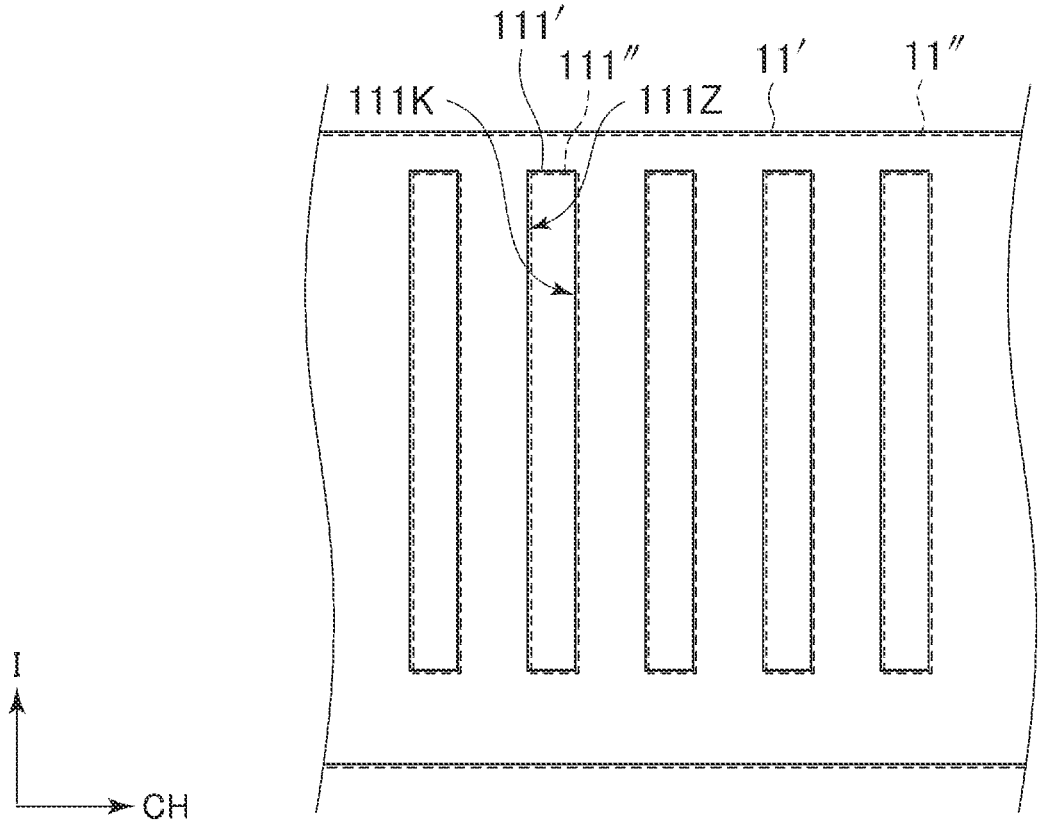
FIG. 15 is a drawing showing a positional relationship between slots, when the plurality of first collimator plates is moved toward the top-end block.
Figure 18:
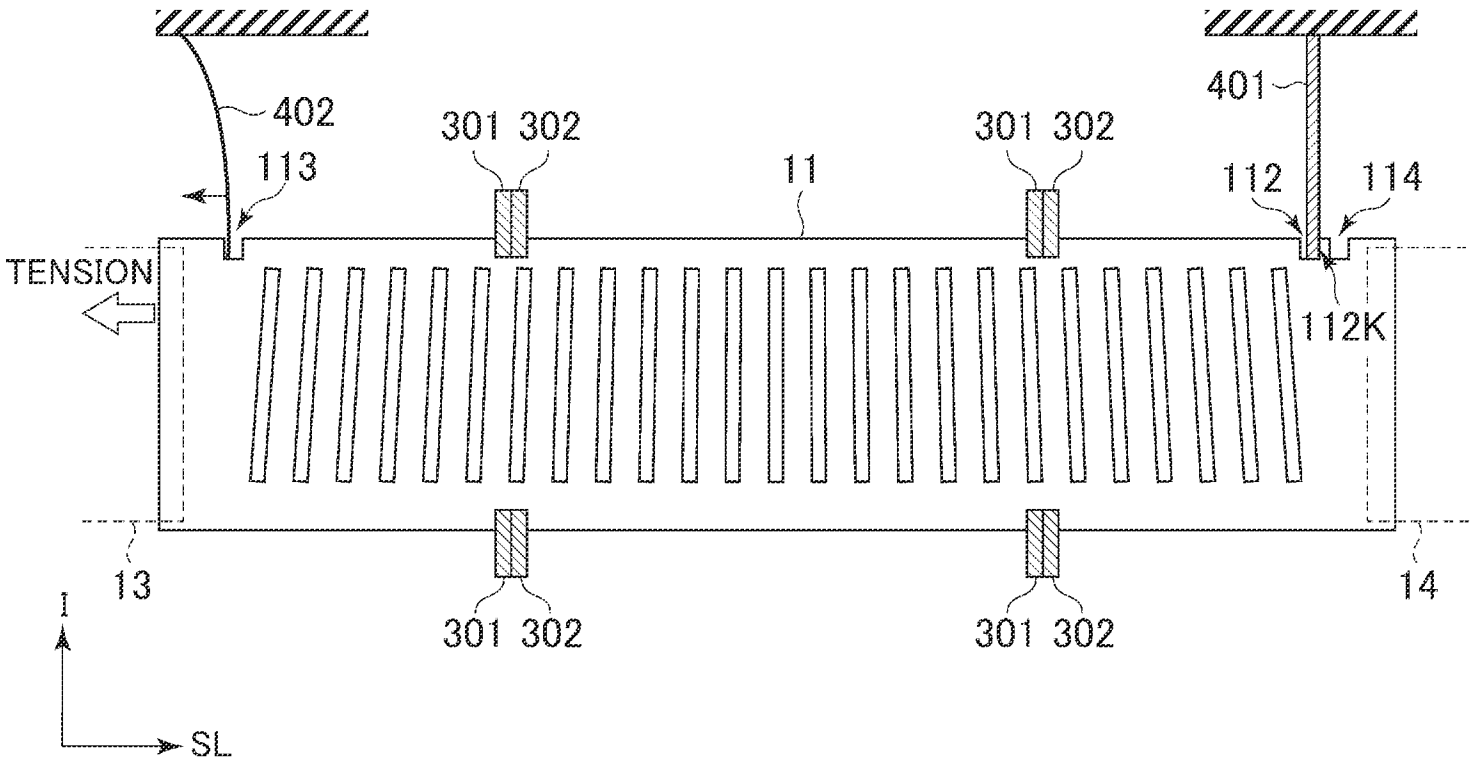
FIG. 18 is a drawing showing a step of aligning slots by moving the plurality of first collimator plates toward the top-end block.

In step S114, as shown in FIG. 8 and FIG. 18, a positioning ruler 401 with an plane extending straight in the CH direction is placed accurately at a predetermined position. The predetermined position is a position having a predetermined positional relationship with the top-end block 13 and bottom-end block 14, and is determined so that the plane is located inside the first cutout 112. Also, a tip of a comb-shaped first spring plate 402 is hooked onto a side wall of the second cutout 113. Then, by moving the first spring plate 402 toward the −SL direction, the plurality of first collimator plates 11 is pulled toward the top-end block 13 (in the −SL-direction). As shown in FIG. 13, the side walls 112K of the first cutouts 112 of the first collimator plates 11 contact the plate surface of the positioning ruler 401 in the +SL-direction. As a result, as shown in FIG. 15, each slot 111' of the odd-numbered first collimator plates 11' and each slot 111" of the even-numbered first collimator plates 11" are aligned in the CH-direction. Thus, the second collimator plates 12 can be easily inserted to the slots 111.

Figure 9:
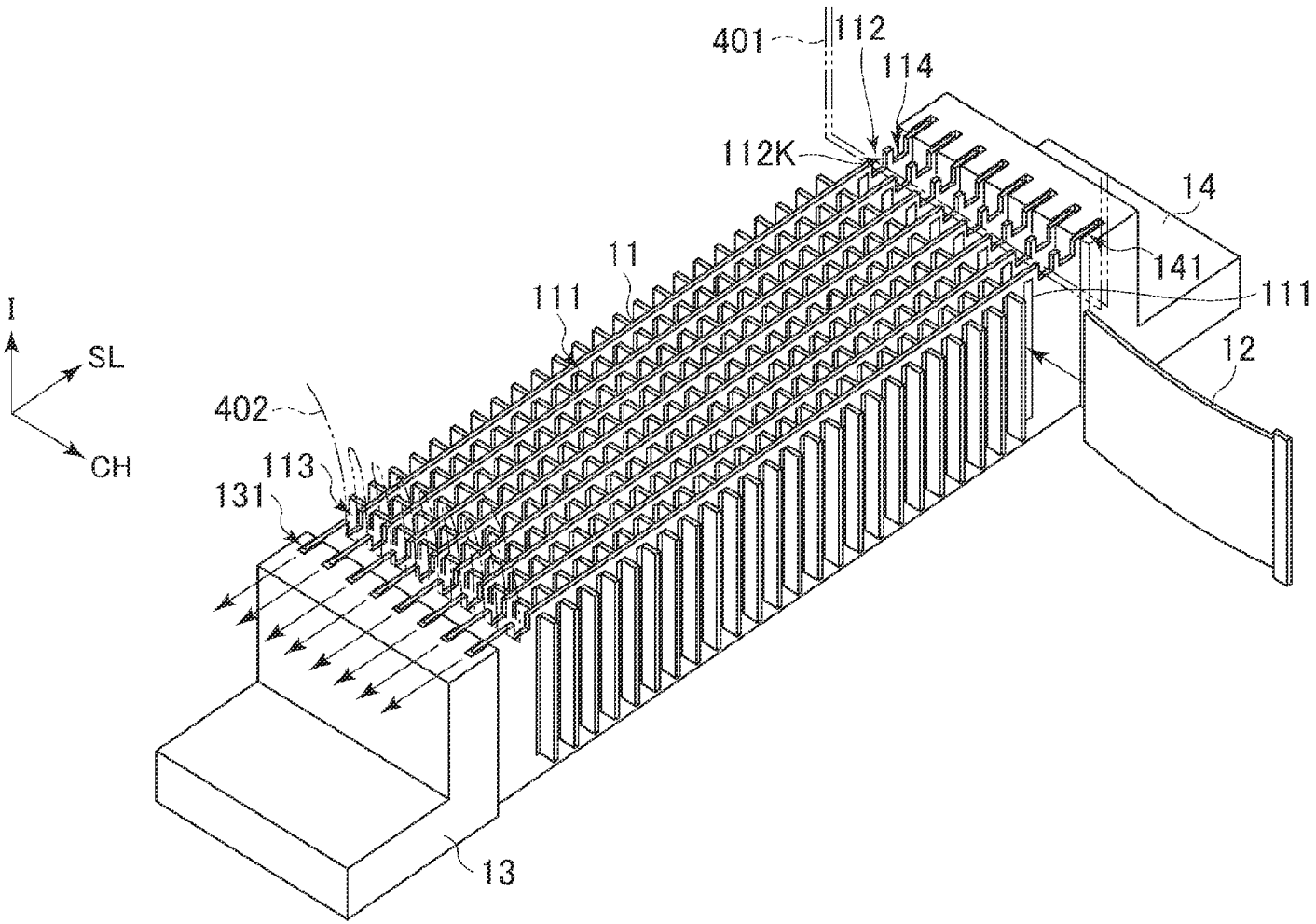
FIG. 9 is a drawing explaining inserting second collimator plates into the slots.
Figure 16:
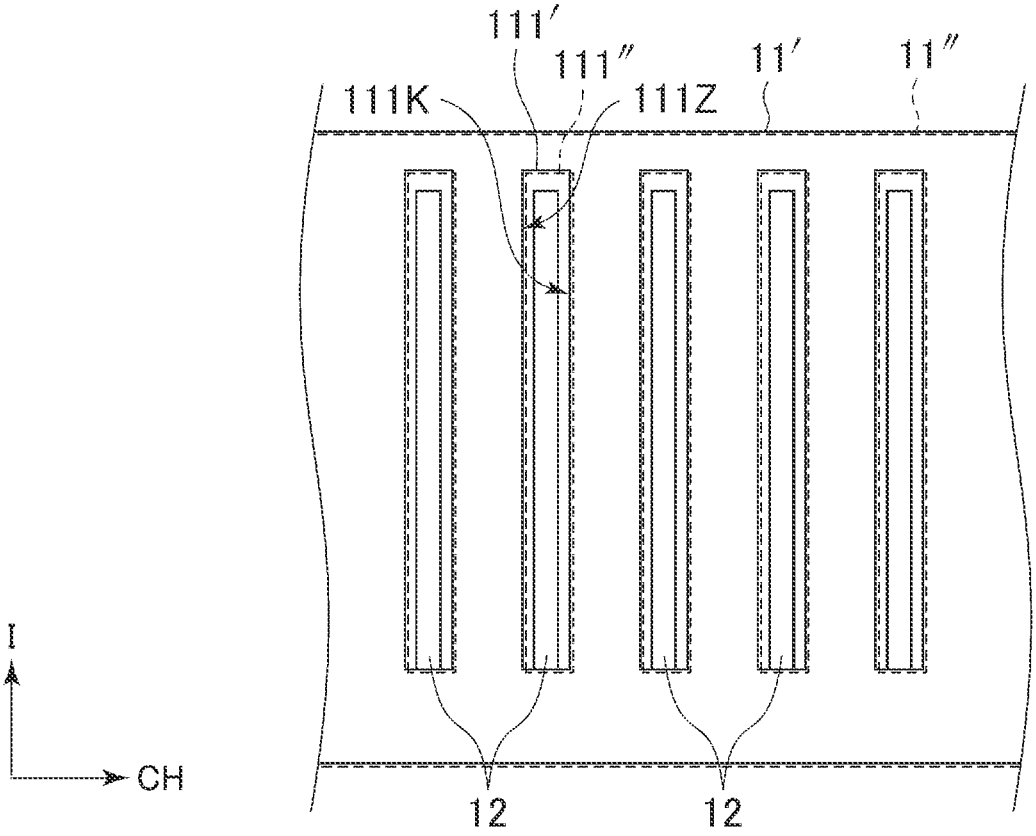
FIG. 16 is a drawing showing a positional relationship between the slots and the second collimator plate, when the second collimator plate is inserted into the slot.

In step S115, as shown in FIG. 9, a plurality of second collimator plates 12 is inserted to respective slots 111 until it stops. FIG. 16 shows a positional relationship between the slot 111' of the odd-numbered first collimator plate 11', the slot 111" of the even-numbered first collimator plate 11" and the second collimator plate 12 at this point.

Figure 10:
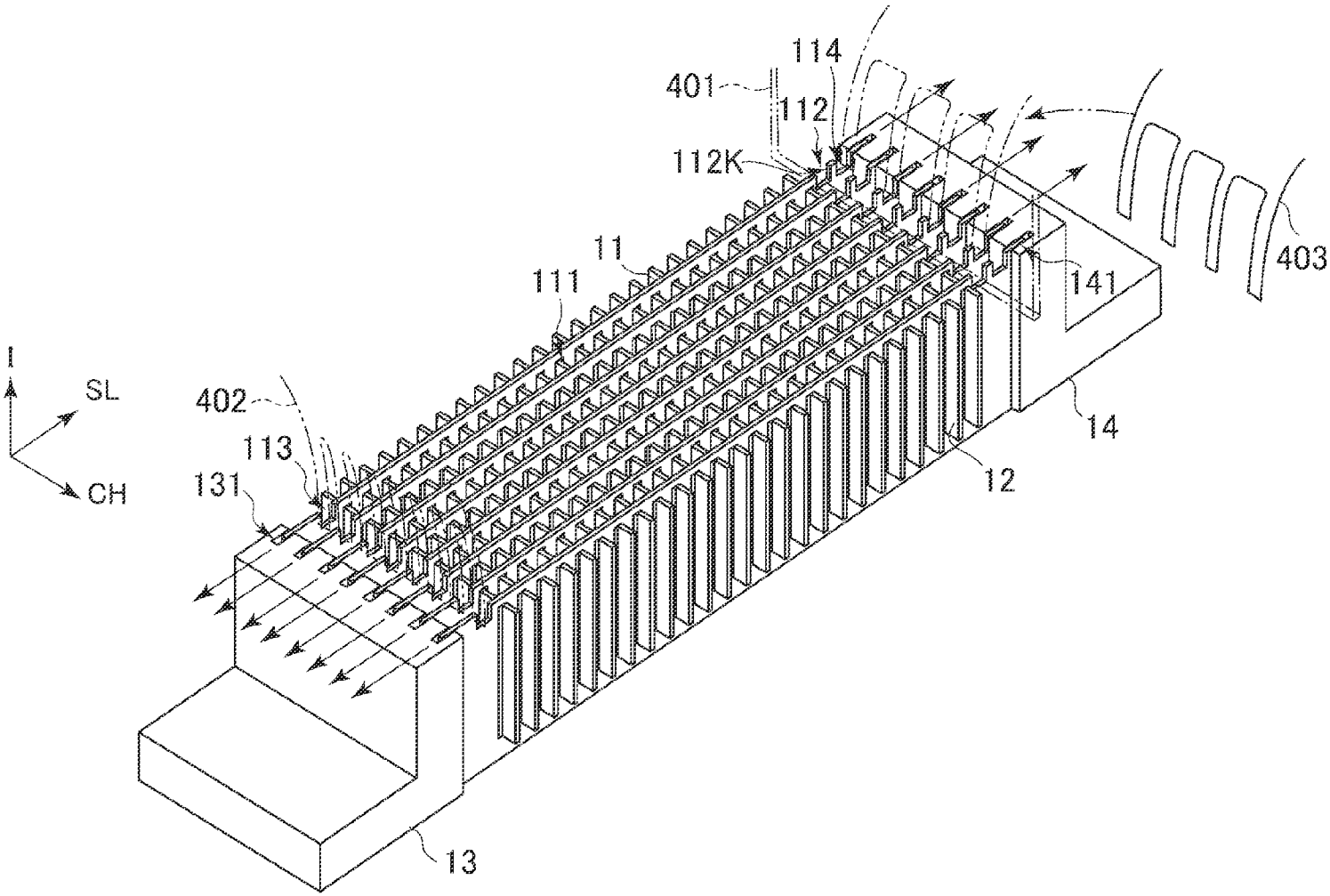
FIG. 10 is a drawing explaining a step for moving part of the plurality of first collimator plates toward the bottom-end block and aligning the slots.
Figure 14:
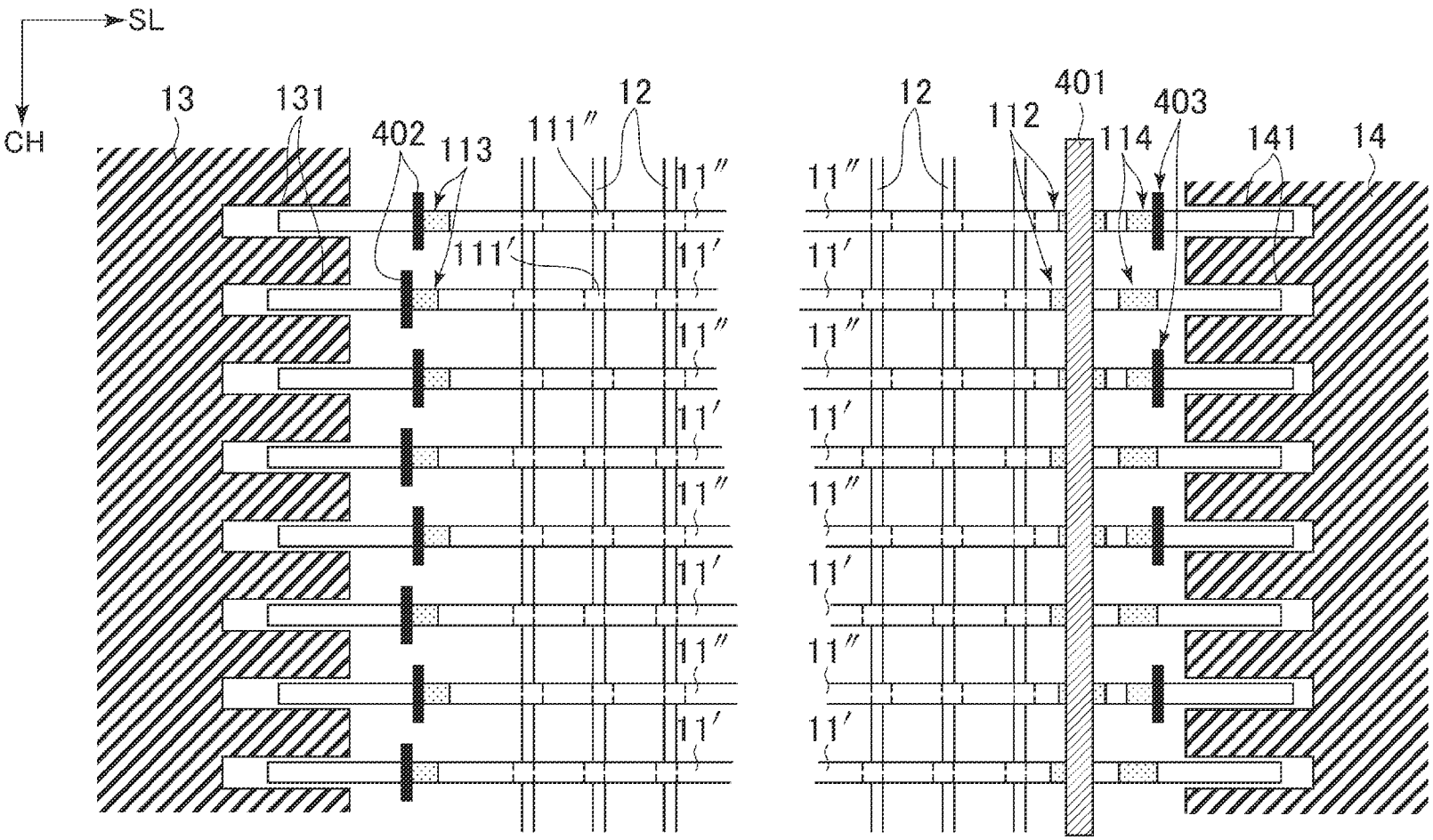
FIG. 14 is an enlarged view around the grooves, wherein the plurality of first collimator plates is moved toward the bottom-end block.
Figure 19:
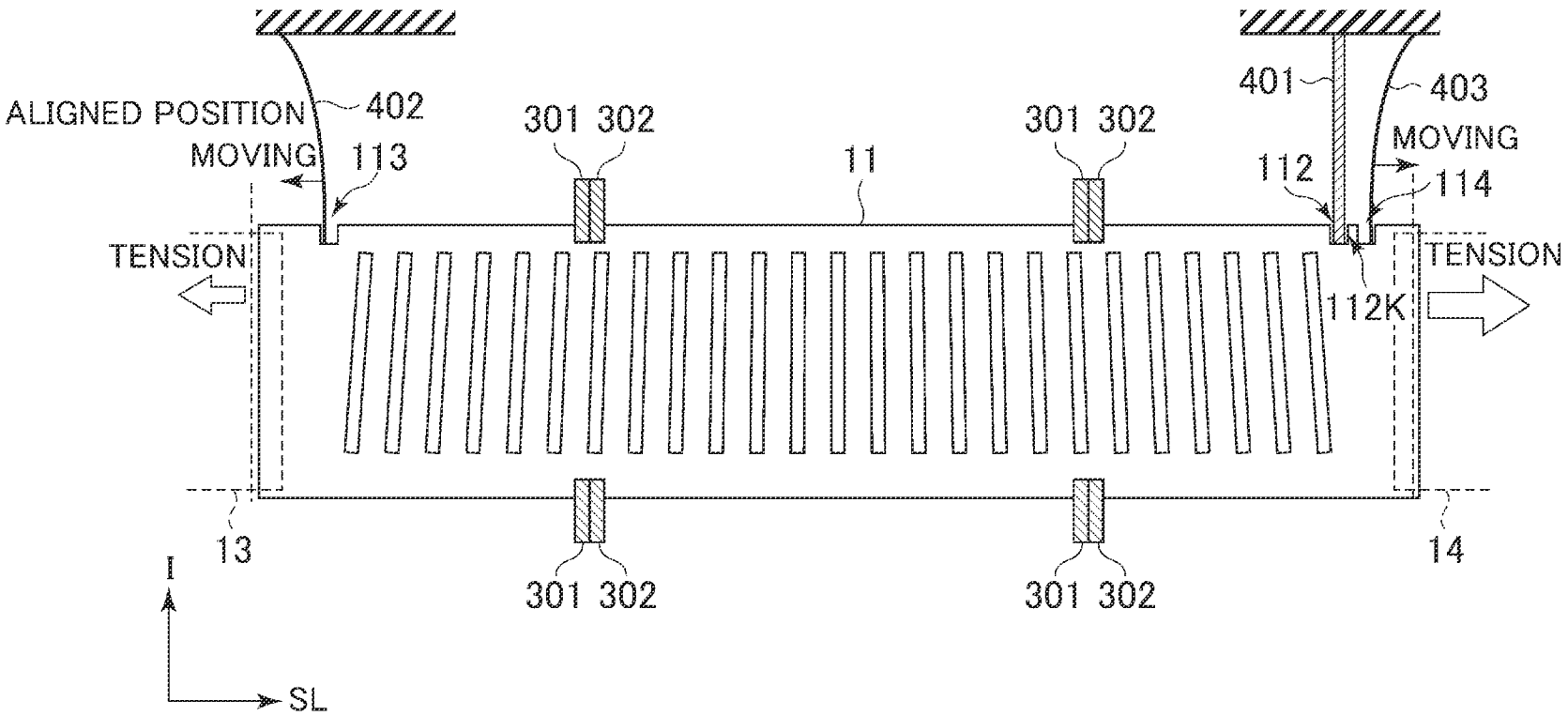
FIG. 19 is a drawing showing a step of aligning slots by moving the plurality of first collimator plates toward the bottom-end block.

In step S116, as shown in FIG. 10 and FIG. 19, each tip on a comb-shaped second spring plate 403 is hooked onto a said wall of the third cutout 114" of the even-numbered first collimator plates 11". Then, by moving the second spring plate 403 toward the +SL direction with a tension stronger than that of the first spring plate 402, the even-numbered first collimator plates 11" are pulled toward the bottom-end blocks 14 (+SL direction). Then, as shown in FIG. 14, the second collimator plates 12 are sandwiched in between the side walls of the slots 111' of the odd-numbered first collimator plates 11' and the side walls of the slots 111" of the even-numbered first collimator plates 11". As a result, as shown in FIG. 17, the plate surface of the second collimator plates 12 in the +SL-direction contact the reference surface which is the side wall 111K of the slots 111' of the odd-numbered first collimator plates 11' in the +SL-direction, then the second collimator plates 12 are placed at correct positions.

In step S117, a plurality of first collimator plates 11 is re-positioned using the jig and the like. Here, by using the jigs (the comb-shaped aligning members 301, 302) shown in FIG. 12, both top and bottom edges of the first collimator plates 11 are firmly nipped in the CH direction. At this point, the first collimator plates 11 are fixed.

In step S118, the plurality of first collimator plates 11, the plurality of second collimator plates 12, the top-end block 13 and the bottom-end block 14 are bonded together using adhesive under such a condition. Then, the two-dimension collimator module 200 is assembled.

Figure 11:
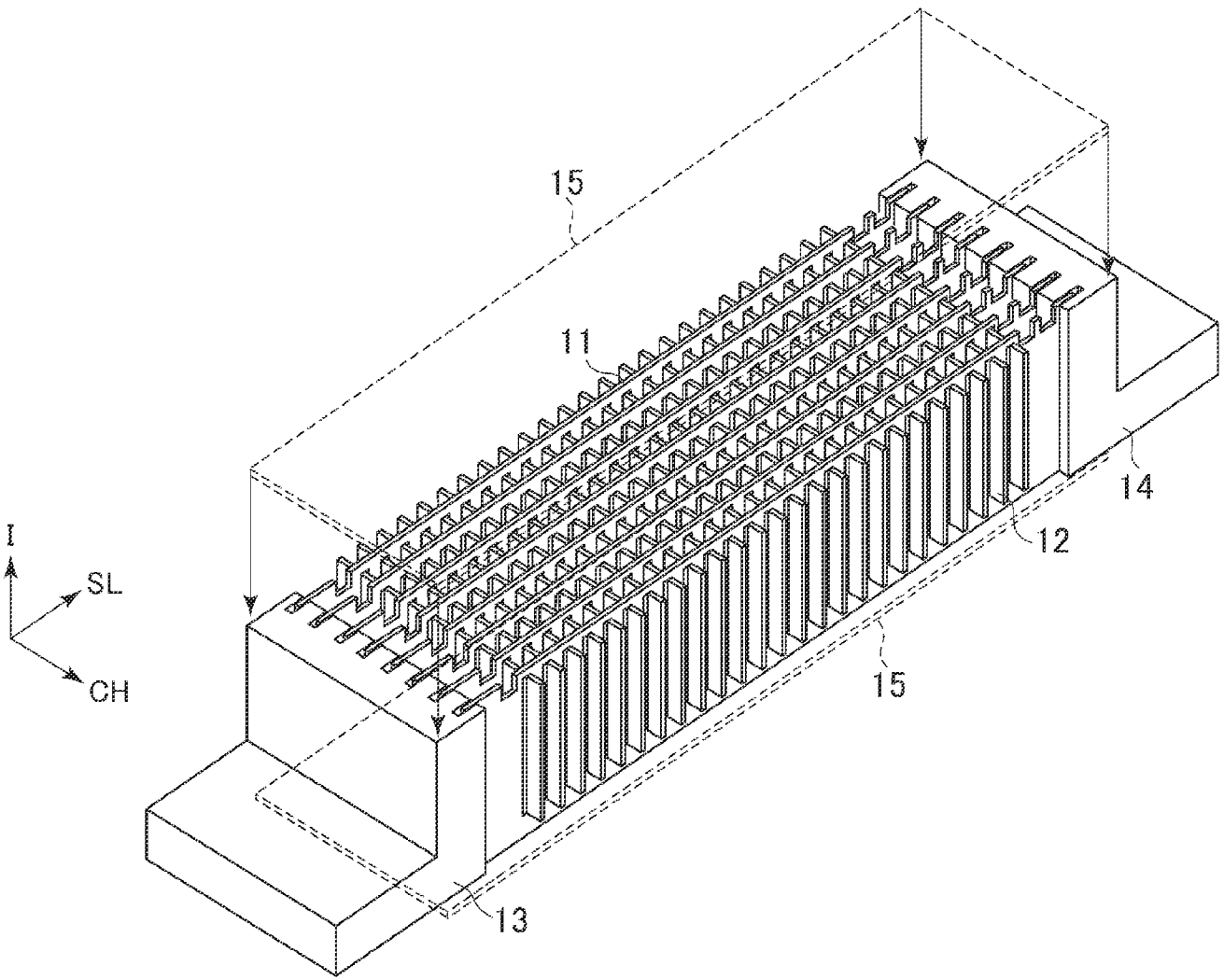
FIG. 11 is a drawing explaining a step for placing an X-ray transparent fixing sheet on an X-ray incident side surface and/or X-ray output side surface.

Additionally, in order to increase rigidity of the two-dimension collimator module 200, as shown in FIG. 11, an X-ray transparent fixing sheet 15 can be pasted onto at least one surface of the X-ray incident side and the X-ray output side. The fixing sheet 15 is constituted with, for example, carbon reinforced plastic (CFRP) having high rigidity, lightweight and high X-ray transparency. The fixing sheet 15 can have grooves on its sheet surface, for receiving the top or bottom edges of the first collimator plates 11.

As described above, in this embodiment, a two-dimension collimator module can be assembled with high precision at low cost, since the positioning of collimator plates is realized using the cutouts of the collimator plates having high precision and easily processed.

Also, the two-dimension collimator module can be easily assembled and has high positioning precision depending on the movement of the first collimator plate 11 in the SL direction, since inserting the second collimator plate 12 into the slot 111 can be made easier by aligning the position of the slot 111, or positioning can be acquired by putting the first collimator plates 11 and second collimator plates 12 on the reference surface.

In order to make the insertion of the second collimator plate 12 into the slot 111 easier, the width of the slot 111 needs to have a plenty of width than the plate thickness of the second collimator plate 12. In this case, the looseness becomes large, which normally makes the positioning precision of the second collimator plate 12 worse. On the other hand, if the width of the slot 111 is almost the same of the thickness of the second collimator plate 12, the positioning precision of the second collimator plate 12 improves; however, the insertion of the second collimator plate 12 into the slot 111 becomes not easy, which decreases the assembly productivity.

Whereas in the exemplary embodiment, the first collimator plates 11 are moved toward the top-end block 13 so that the position of the slots 111 is aligned, and the second collimator plates 12 are inserted into the slots 111, and some of the first collimator plates 11 is moved toward the bottom-end block 14 so that the second collimator plates 12 are sandwiched in and positioned at correct positions. Therefore, in the exemplary embodiment, even if the width of the slots 111 is relatively large in comparison to the plate thickness of the second collimator plate 12 to make the insertion of the second collimator plate 12 easer, high precision of the positioning can be acquired. This can increase a degree of freedom between the width of the slot 111 and plate thickness of the second collimator plate 12, and both can be made in a relatively good size.

Exemplary embodiments are described above; however, it will be obvious to persons who are skilled in the relevant art to modify the embodiments specifically described herein based on this disclosure.

For example, in the embodiment above, although the first to third cutouts are formed on the edges of the X-ray incident side of the first collimator 11, however, at least a part of the first to third cutouts can be formed on the edges of the X-ray output side of the first collimator 11.

Figure 20:
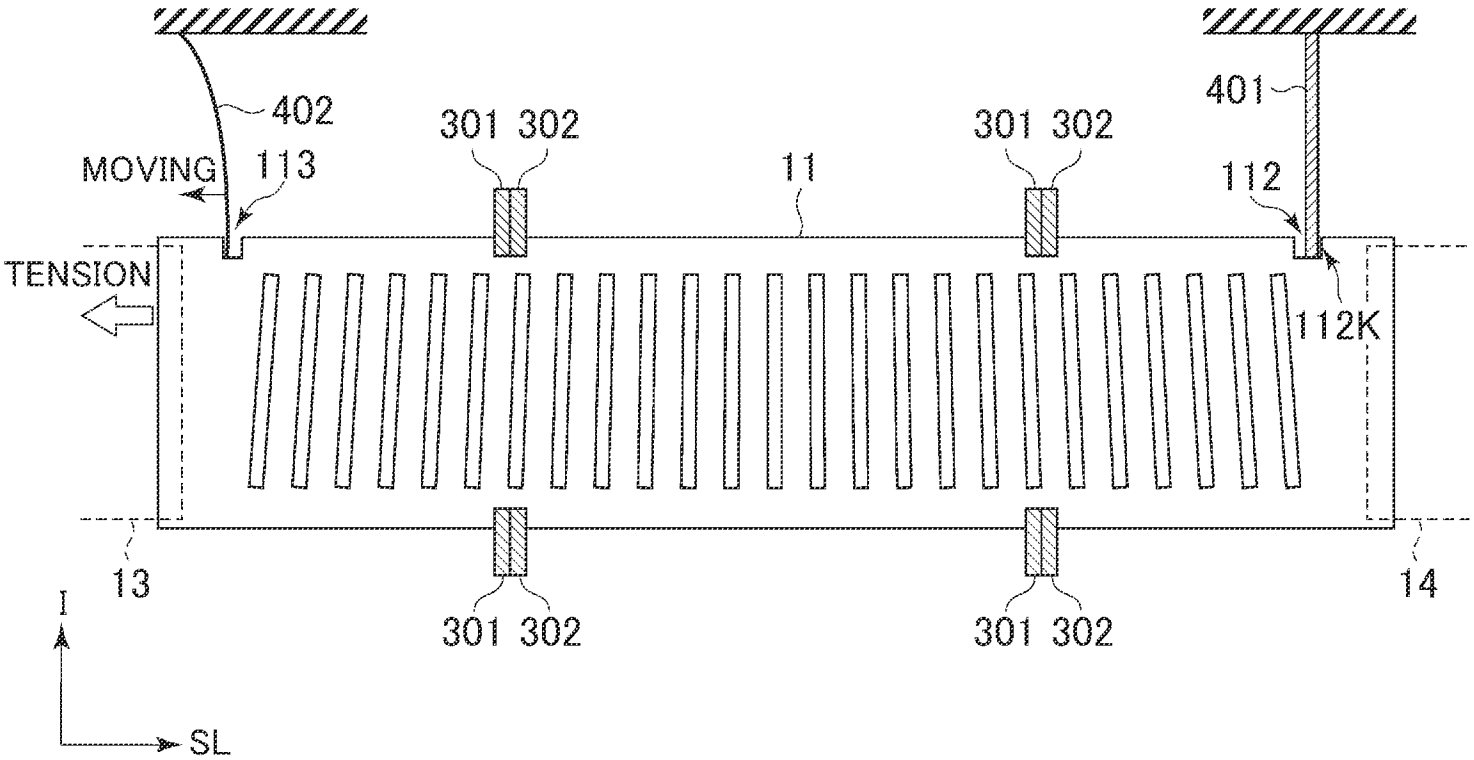
FIG. 20 is a drawing explaining a first example of the first collimator plate in another embodiment and positioning method thereof.
Figure 21:
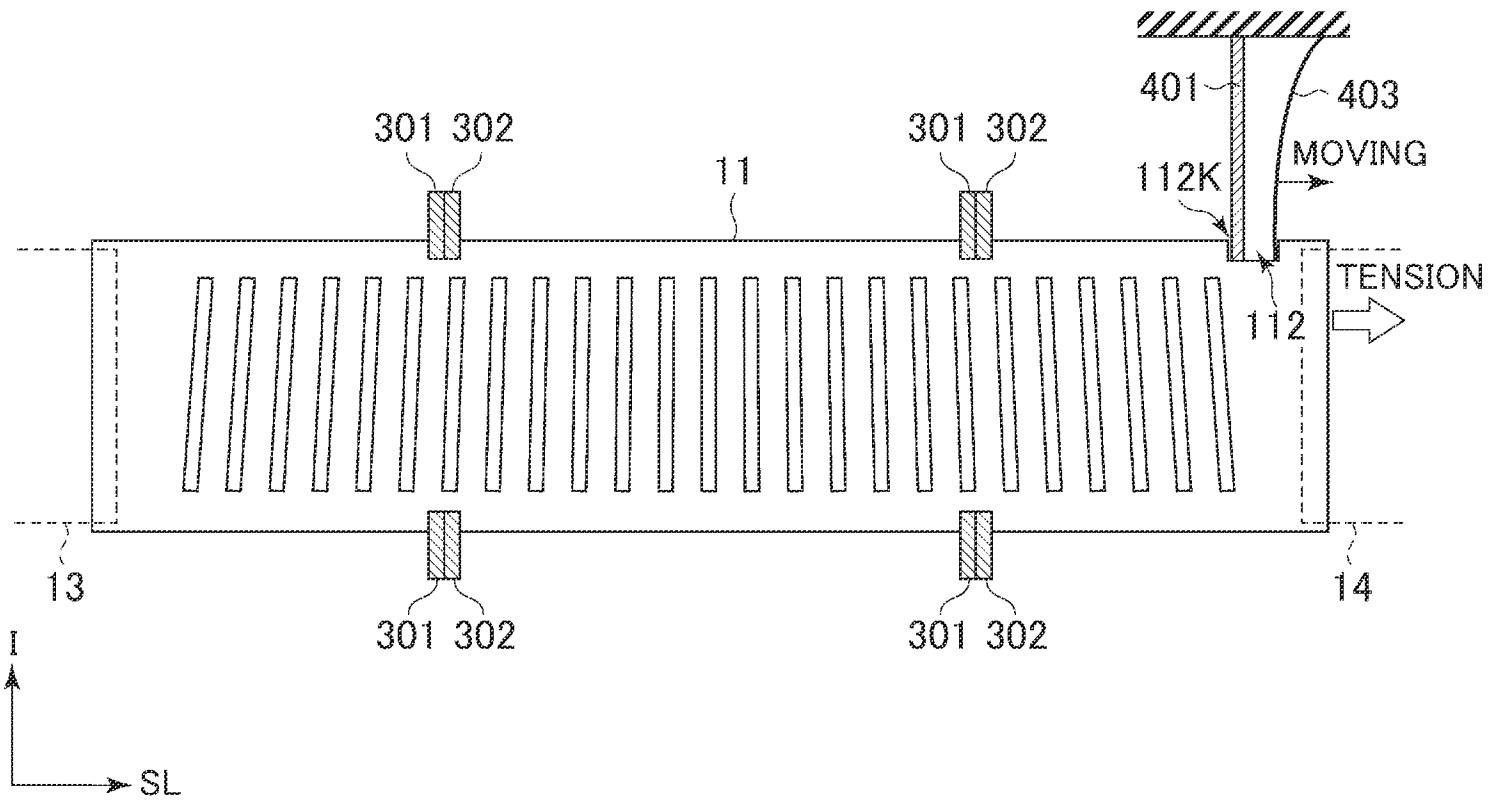
FIG. 21 is a drawing explaining a second example of the first collimator plate in another embodiment and positioning method thereof.

Also, in the embodiment above, the plurality of first collimator plates 11 is moved toward the −SL direction temporarily, the second collimator plates 12 are inserted to the respective slots 111, a part of the first collimator plates 11 is moved toward the +SL direction and the second collimator plates 12 are sandwiched in between side walls of the slots 111. However, when the width of slot 111 is narrowed to the plate thickness of the second collimator plate 12, the positioning of the first collimator plates 11 is necessary for only once. In this case, as shown in FIG. 20, for example, without forming the third cutout 114, the first collimator plate 11 can be positioned by placing a positioning ruler 401 inside the first cutout 112, hooking the first spring plate 402 to the second cutout 113 and pulling the first spring plate 402. Also, as shown in FIG. 21 for example, without forming the second cutout 113 and third cutout 114, the first collimator plate 11 can be positioned by placing the positioning ruler 401 inside the first cutout 112, hooking the first spring plate 402 to the first cutout 112 and pulling the first spring plate 402. In this case, a side wall of the first cutout 112 to contact the positioning ruler 401 is a reference wall for positioning.

Also, in the embodiments above, a main portion of the second collimator plate 12 has a fan-shape that fans along the X-ray beam direction; however this can be rectangular shaped.

Further, for example, although the embodiments above are explained based on a collimator module that shields the X-ray, the embodiments described herein can be applied to other applications for shielding other radiating beams, such as gamma rays.

The present invention not only relates to a collimator module and assembling method thereof. It can also be used for an X-ray detection device having a plurality of collimator modules, a simple roentgenography apparatus having such X-ray detection device and the X-ray CT apparatus.

What is claimed is:

1. A method for assembling a collimator module, the collimator module including a plurality of first collimator plates arrayed in a first direction, each first collimator plate having a plurality of slots formed on a plate surface, and a plurality of second collimator plates arrayed in a second direction orthogonal to the first direction, wherein each second collimator plate penetrates respective slots along the first direction so as to form a lattice-shape, the method comprising:

positioning the plurality of first collimator plates by moving a first collimator plate in one direction along the second direction, so that a side wall of a first cutout formed on an edge of an x-ray radiation incident side or an x-ray radiation output side of the first collimator plate contacts a member extending in the first direction.

2. The method for assembling the collimator module according to claim 1, wherein when positioning the plurality of first collimator plates, the first collimator plate is moved by hooking a springy member on the first cutout and pulling the first collimator plate with a tension.

3. The method for assembling the collimator module according to claim 2, further comprising, after positioning the plurality of first collimator plates:

inserting the plurality of second collimator plates into the respective slots; and sandwiching each second collimator plate between the side walls of each slot by hooking the springy member on the first cutouts of a part of the plurality of first collimator plates and moving the part of the plurality of first collimator plates in a direction opposite to the one direction.

4. The method for assembling the collimator module according to claim 2, further comprising, after positioning the plurality of first collimator plates:

inserting the plurality of collimator plates into the respective slots; and sandwiching each second collimator plate between the side walls of each slot by hooking the springy member on a third cutout which is different from the first cutout and formed on one end side along the second direction of the edge of a part of the plurality of first collimator plates and moving the part of the plurality of first collimator plates in a direction opposite to the one direction.

5. The method for assembling the collimator module according to claim 4, wherein the part of the plurality of first collimator plates is one of odd and even numbered collimator plates of the plurality of first collimator plates.

6. The method for assembling the collimator module according to claim 1, wherein when positioning the plurality of first collimator plates, the first collimator plate is moved by hooking a springy member on a second cutout which is different from the first cutout and is formed on the edge of the first collimator plate, and pulling the first collimator plate with a tension.

7. The method for assembling the collimator module according to claim 6, wherein the first cutout is formed on one end side along the second direction of the edge, and the second cutout is formed on the other end side along the second direction of the edge.

8. The method for assembling the collimator module according to claim 6, further comprising, after positioning the plurality of first collimator plates:

inserting the plurality of second collimator plates into the respective slots; and sandwiching each second collimator plate between the side walls of each slot by hooking the springy member on the first cutouts of a part of the plurality of first collimator plates and moving the part of the plurality of first collimator plates in a direction opposite to the one direction.

9. The method for assembling the collimator module according to claim 6, further comprising, after positioning the plurality of first collimator plates:

inserting the plurality of second collimator plates into the respective slots; and sandwiching each second collimator plate between the side walls of each slot by hooking the springy member on a third cutout which is different from the first cutout and formed on one end side of the edge of a part of the plurality of first collimator plates along the second direction, and moving the part of the plurality of first collimator plates in a direction opposite to the one direction.

10. The method for assembling the collimator module according to claim 9, wherein the part of the plurality of first collimator plates is one of odd and even numbered collimator plates of the plurality of first collimator plates.

11. The method for assembling the collimator module according to claim 1, further comprising, prior to positioning the plurality of first collimator plates:

placing a first block and a second block with a space therebetween in the second direction, wherein the first and second blocks have respective grooves for placing the edges of the plurality of first collimator plates along the second direction; and inserting the plurality of first collimator plates into the respective grooves.

12. The method for assembling the collimator module according to claim 11, further comprising bonding the plurality of first collimator plates, the plurality of second collimator plates, and the first block and the second block.

13. The method for assembling the collimator module according to claim 1, wherein the collimator module is configured to be used with an x-ray radiation tomographic imaging apparatus.

14. The method for assembling the collimator module according to claim 1, wherein the collimator module is configured to be used with an x-ray radiation projection imaging apparatus.

* * * * *